US008206116B2

(12) United States Patent
Pickens et al.

(10) Patent No.: US 8,206,116 B2
(45) Date of Patent: Jun. 26, 2012

(54) METHOD FOR LOADING AND LOCKING TANGENTIAL ROTOR BLADES AND BLADE DESIGN

(75) Inventors: John Pickens, Middletown, CT (US); Phillip Alexander, Colchester, CT (US); Roland Barnes, Bloomfield, CT (US)

(73) Assignee: United Technologies Corporation, Hartford, CT (US)

( * ) Notice: Subject to any disclaimer, the term of this patent is extended or adjusted under 35 U.S.C. 154(b) by 509 days.

(21) Appl. No.: 11/181,620

(22) Filed: Jul. 14, 2005

(65) Prior Publication Data

US 2007/0014667 A1 Jan. 18, 2007

(51) Int. Cl.
*F01D 5/32* (2006.01)

(52) U.S. Cl. ..... 416/215; 416/218; 416/239; 29/889.21

(58) Field of Classification Search ..... 416/215–218, 416/219 R, 220 R, 221, 239, 248; 29/889.21, 29/889.22

See application file for complete search history.

(56) References Cited

U.S. PATENT DOCUMENTS

| | | | | |
|---|---|---|---|---|
| 2,414,278 | A * | 1/1947 | Soderberg | 416/217 |
| 3,088,708 | A * | 5/1963 | Feinberg | 416/215 |
| 3,955,898 | A | 5/1976 | Zaehring | |
| 4,465,432 | A | 8/1984 | Mandet et al. | |
| 4,684,325 | A | 8/1987 | Arnold | |
| H1258 | H * | 12/1993 | Hindle, Jr. | 416/215 |
| 5,522,706 | A | 6/1996 | Mannava et al. | |
| 6,033,185 | A | 3/2000 | Lammas et al. | |
| 6,332,617 | B1 * | 12/2001 | Leveaux et al. | 416/221 |
| 6,375,429 | B1 * | 4/2002 | Halila et al. | 416/193 A |
| 6,464,463 | B2 * | 10/2002 | Yvon Goga et al. | 416/215 |
| 6,752,598 | B2 * | 6/2004 | Antunes et al. | 416/215 |
| 7,334,331 | B2 * | 2/2008 | Bouchard et al. | 29/889.23 |
| 2004/0076523 | A1 * | 4/2004 | Sinha et al. | 416/219 R |

FOREIGN PATENT DOCUMENTS

| | | | |
|---|---|---|---|
| EP | 0942149 | A1 | 9/1999 |
| EP | 1321630 | A2 | 6/2003 |
| FR | 2664944 | A | 1/1992 |
| FR | 2715968 | A1 | 8/1995 |
| GB | 2171150 | A | 8/1986 |
| JP | 58104304 | A | 6/1983 |

OTHER PUBLICATIONS

JP Office Action dated Jan. 20, 2009.

* cited by examiner

*Primary Examiner* — Christopher Verdier
(74) *Attorney, Agent, or Firm* — Bachman & LaPointe, P.C.

(57) ABSTRACT

An array of blades for use in an engine includes a disk having a slot, a pair of rails adjacent the slot and extending above an upper surface of the slot, and a pair of shoulders located outside the rails. A plurality of radially loaded blades are inserted into the slot. A plurality of snaps overhang the rails and rest on the shoulders. Each of the blades is positioned between a pair of snap seals and overlaps a side edge of each one of the pair of snap seals.

20 Claims, 23 Drawing Sheets

METHOD FOR LOADING AND LOCKING TANGENTIAL ROTOR BLADES AND BLADE DESIGN

BACKGROUND OF THE INVENTION (1) Field of the Invention

The present invention relates to a method of loading and locking tangential rotor blades and to a blade array having a new blade design.

(2) Prior Art

Gas turbine engines have a plurality of compressors arranged in flow series, a plurality of combustion chambers, and a plurality of turbines arranged in flow series. The compressors typically include at least a high pressure compressor and a low pressure compressor which are respectively driven by a high pressure turbine and a low pressure turbine. The compressors compress the air which has been drawn into the engine and provide the compressed air to the combustion chambers. Exhaust gases from the combustion chambers are received by the turbines which provide useful output power. Each compressor typically has a plurality of stages.

The main components of a typical tangential stage in a high pressure compressor are the disk, the blades, the ladder seals and the locks. FIG. 1 illustrates a cross section of the rear stages of a typical compressor. The blades 10 and the disk 12 are shown in FIG. 1. View X in FIG. 1 isolates the attachment portion of the disk 12. FIG. 2 shows the disk 12 with the loading slot 14 and the lock slots 16. FIG. 3 illustrates a top view of a ladder seal 18. FIG. 4 illustrates a cross section of the lock 20 and the disk 12.

The assembly sequence for a typical tangential stage is as follows. First, the ladder seal 18 is assembled to the inner rail of the disk 12 with a first slot 22 of the ladder seal 18 positioned directly over the loading slot 14 in the disk 12. Second, a first blade (not shown) is assembled through the ladder seal 18 and through the loading slot 14 in the disk 12. Then the blade and ladder seal 18 are rotated around the circumference of the disk 12 until the next slot 24 of the ladder seal 18 is positioned directly over the loading slot 14. In a similar fashion the next blade is loaded and rotated. Once the blades have been completely loaded and rotated in the ladder seal segment, the lock 20 is assembled through the load slot 14 and rotated to the lock slot position and tightened. The lock 20 prevents the circumferential motion of the blades, which insures that work will be done on the air and that the blades will not comeback out through the load slot.

Since locking and loading slots form discontinuities in tangential rotor disks, they have been known to initiate thermal mechanical fatigue (TMF) cracking. The root cause of any TMF cracking is the thermal gradients that exist at certain flight points. One flight point may produce a cold bore and a hot rim, which would put the rim (including the loading and locking slots) into compression. Another flight point may produce a hot bore and a cold rim which would put the rim into tension. This cyclic loading fatigues the disk. The locking and loading slots may make this condition worse by introducing stress concentrations due to the discontinuities.

SUMMARY OF THE INVENTION

The present invention removes the loading and locking slots from the disk. A significant improvement in TMF life can be achieved by the removal of these slots, hence reducing the occurrence of cracking in the tangential attachment portion of the disk.

In accordance with the present invention, a method of loading and locking a plurality of tangential rotor blades is provided. The method broadly comprises the steps of providing a disk having a slot and a pair of rails adjacent the slot, positioning a first snap seal in a desired location over the slot and the rails, radially loading a first blade having a platform into the slot and rotating the blade, and positioning the first blade adjacent the snap seal so that a portion of the snap seal slides under the platform.

Further in accordance with the present invention, a rotor blade is provided which has a platform and an airfoil portion extending from the platform, means for attaching the component to a disk positioned beneath the platform, and the attaching means includes a circular neck portion and a dovetail portion.

Still further in accordance with the present invention, a disk is provided which includes a continuous slot and means for receiving a snap seal which fits over the slot and which helps position an engine component.

Yet further in accordance with the present invention, a gas turbine rotor disk is provided which broadly comprises a tangentially directed slot. The slot has an axial, cross sectional profile that is continuous in a tangential direction and an uninterrupted opening extending the length of the slot. The opening has a constant width.

Other details of the method of loading and locking tangential rotor blades and the blade design of the present invention, as well as other objects and advantages attendant thereto, are set forth in the following detailed description and the drawings in which like reference numerals depict like elements.

DETAILED DESCRIPTION OF THE PREFERRED EMBODIMENT(S)

Figure 1:
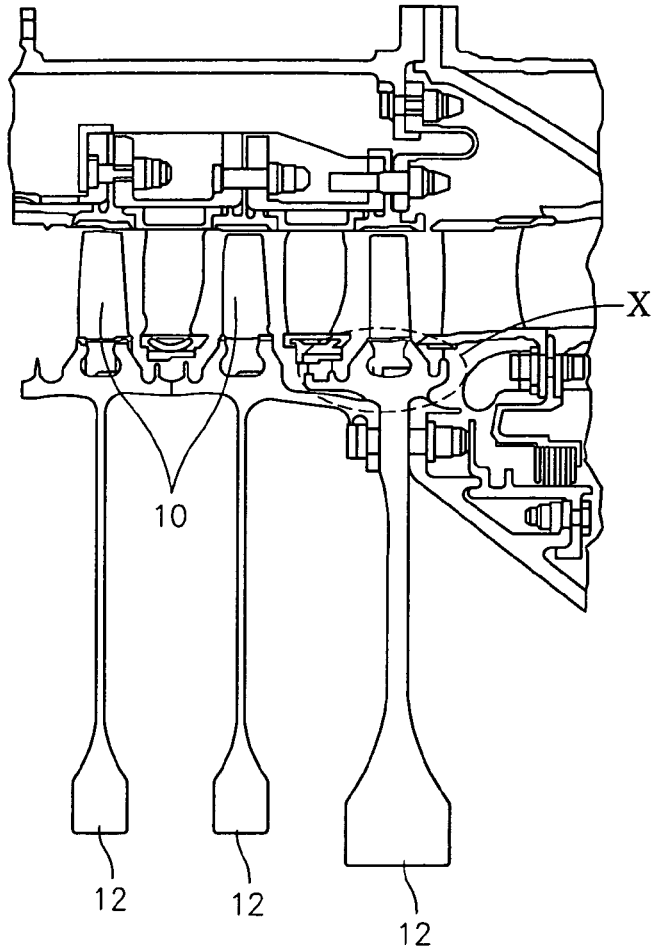
FIG. 1 (PRIOR ART)
FIG. 1 is a cross section of a rear portion of a prior art compressor.
Figure 2:
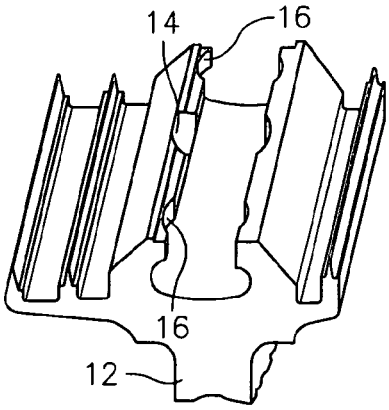
FIG. 2 (PRIOR ART)
FIG. 2 is a perspective view of a prior art disk having load and lock slots.
Figure 3:
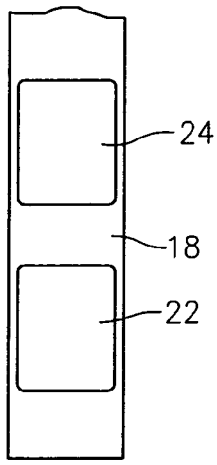
FIG. 3 (PRIOR ART)
FIG. 3 is a top view of a prior art ladder seal.
Figure 4:
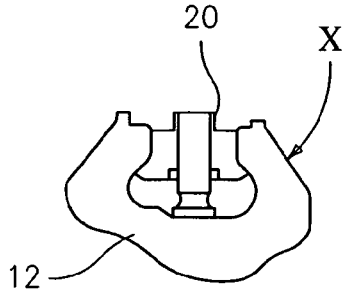
FIG. 4 (PRIOR ART)
FIG. 4 is a cross section of a prior art lock and disk arrangement.
Figure 5:
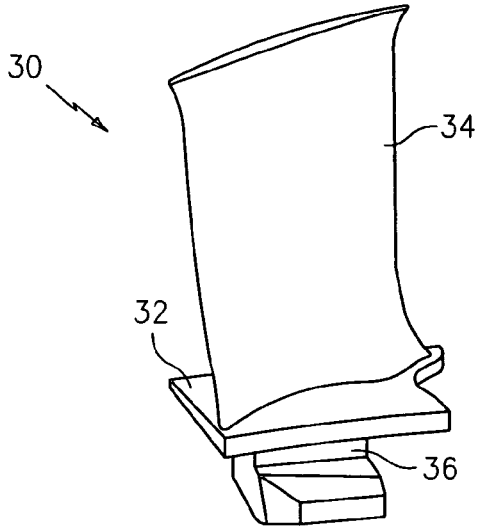
FIG. 5 is a perspective view of a blade in accordance with the present invention.
Figure 6:
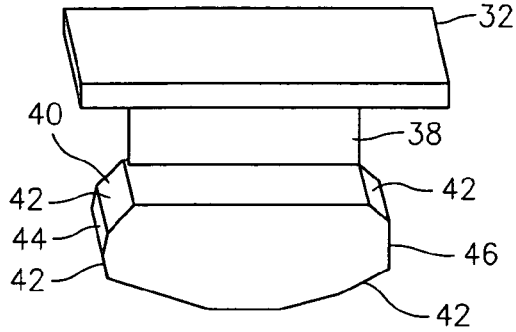
FIG. 6 is a perspective view of the attachment part of the blade of FIG. 5.

Referring now to FIG. 5, there is illustrated a redesigned blade 30 in accordance with the present invention. The blade 30 has a platform 32, an airfoil portion 34 extending radially outward from the platform 32 and an attachment part 36. The geometry of the attachment part 36 includes a neck portion 38 (see FIG. 6) which is circular in shape rather than rectangular. The attachment part 36 further includes a dovetail portion 40 which has a plurality of clearance chamfers 42. In a preferred embodiment of the attachment part 36 of the present invention, each end edge 44 and 46 of the dovetail portion has an upper and a lower clearance chamfer 42. The side walls 48 and 50 of the dovetail portion 40 are each preferably flat to facilitate assembly. The attachment part 36 of the present invention allows each blade 30 to be loaded radially into a slot 52 and rotated into place.

Referring now to FIGS. 7A-7D, there is illustrated the method of loading a blade into a disk 12 having a tangential slot 52. The tangential slot 52 has an axial, cross sectional profile that is continuous in the tangential direction. The slot has an opening 63 which is defined by two rails 58 and 60. The opening 63 is preferably constant in its width (the distance from the rail 58 to the rail 60). As can be seen from FIG. 8, the rails 58 and 60 each run uninterrupted in the tangential direction from one end of the slot 52 to the other end of the slot 52.

Figure 7A:
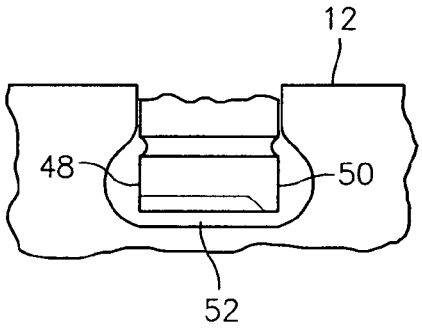
FIGS. 7A-7D illustrate the various positions of the attachment part of the blade of FIG. 5 during loading and in an assembled position.
Figure 7B:
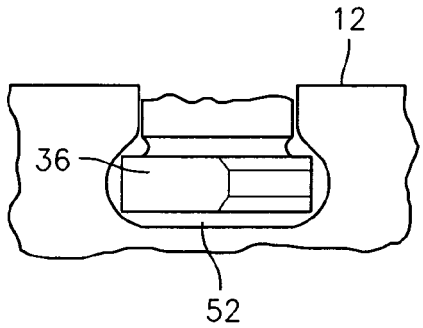
Figure 7C:
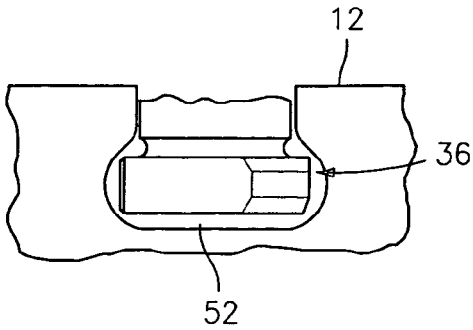
Figure 7D:
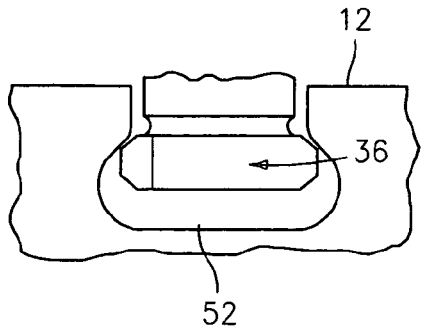
Figure 8:
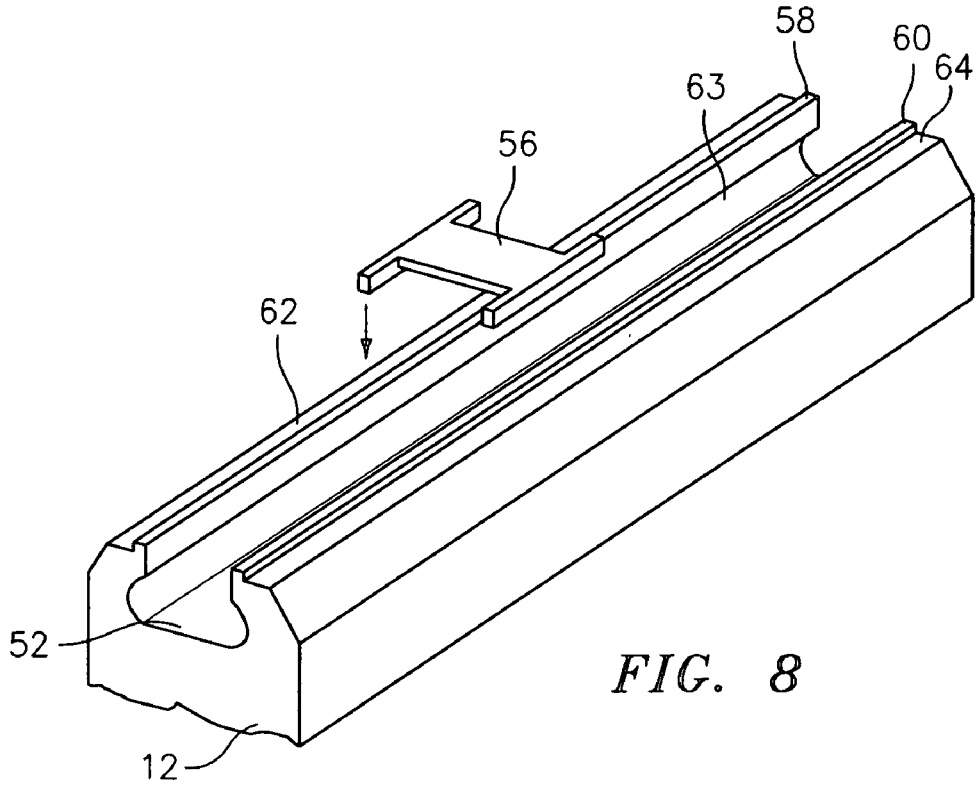
FIGS. 8-33 illustrate the method of loading and locking tangential rotor blades.

As can be seen in FIG. 7A, the attachment part 36 of a blade 30 is loaded into the slot 52 so that the side walls 48 and 50 extend parallel to the longitudinal axis of the slot 52. As shown in FIGS. 7B-7D, the blade 30 and hence the attachment part 36 is rotated to an assembled position wherein the side walls 48 and 50 are positioned perpendicular to the longitudinal axis of the slot 52. As can be seen from FIG. 7D, the upper chamfers 42 are moved into contact with the wall 54 of the slot 52. Unlike previous designs, the blade 30 is rotated radially about its own longitudinal axis. This is different from past designs wherein the blade is rotated circumferentially.

Figure 9:
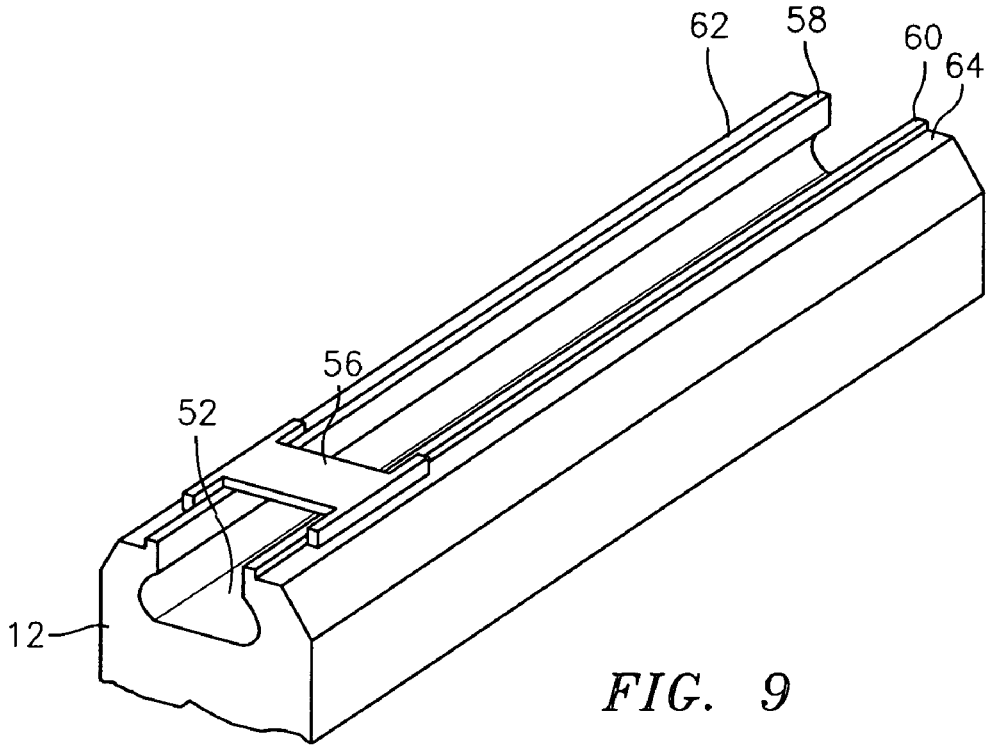
Figure 34:
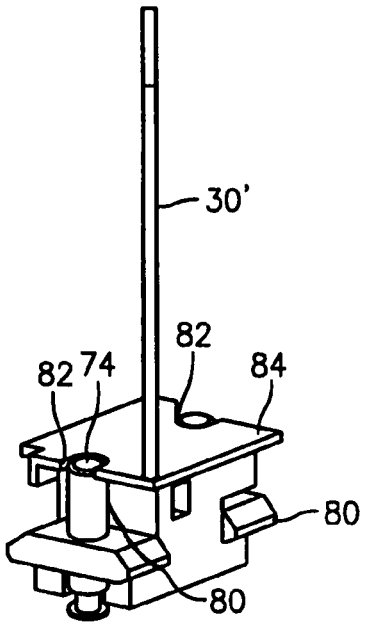
FIG. 34 illustrates a locking blade of the present invention.
Figure 35:
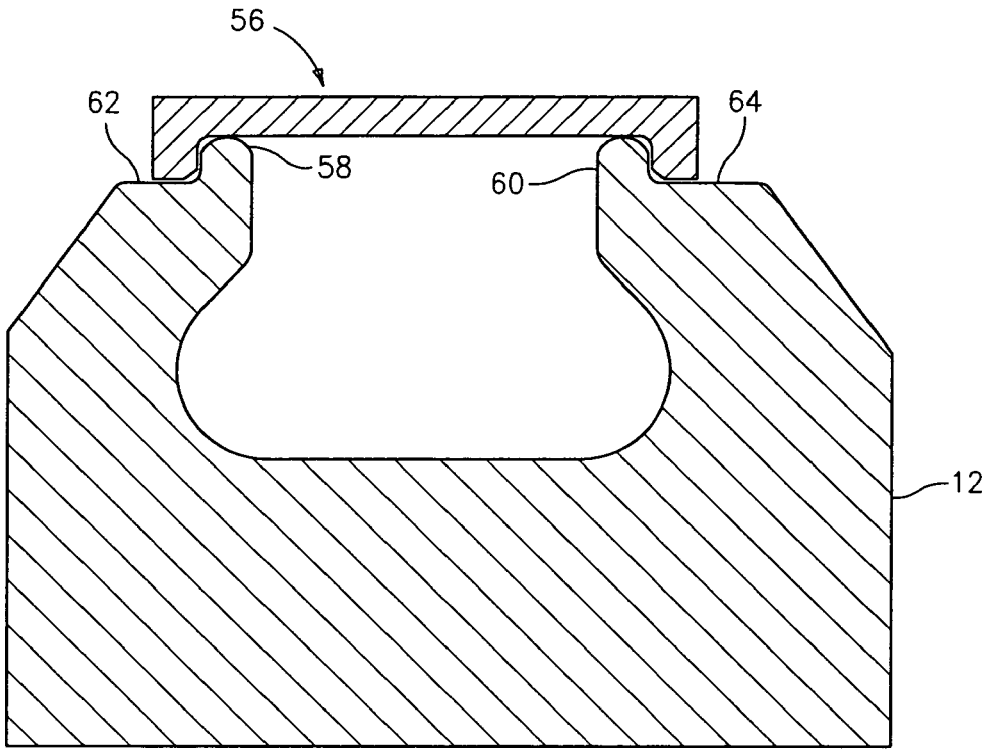
FIG. 35 is a sectional view showing the fit between the snap seal and the disk.

A radial drop down is required to allow for the rotation of the blade 30 in the slot 52. This is because the dovetail portion of the blade 30 must have a cross sectional diameter less than or equal to the disk dovetail at the depth which the blade is radially rotated. As a result, the blade assembly of the present invention uses individual snap seals 56 such as that shown in FIG. 8. During the method of loading and locking a plurality of tangential rotor blades to form a blade array, which method is shown in FIGS. 8-34, each snap seal 56 snaps over each rail 58 and 60 of the disk 12 and rests on the outside shoulders 62 and 64 of the disk 12 as shown in FIGS. 9 and 35. As shown in FIGS. 9 and 35, an interference fit exists between the snap seal 56 and the disk 12.

Figure 10:
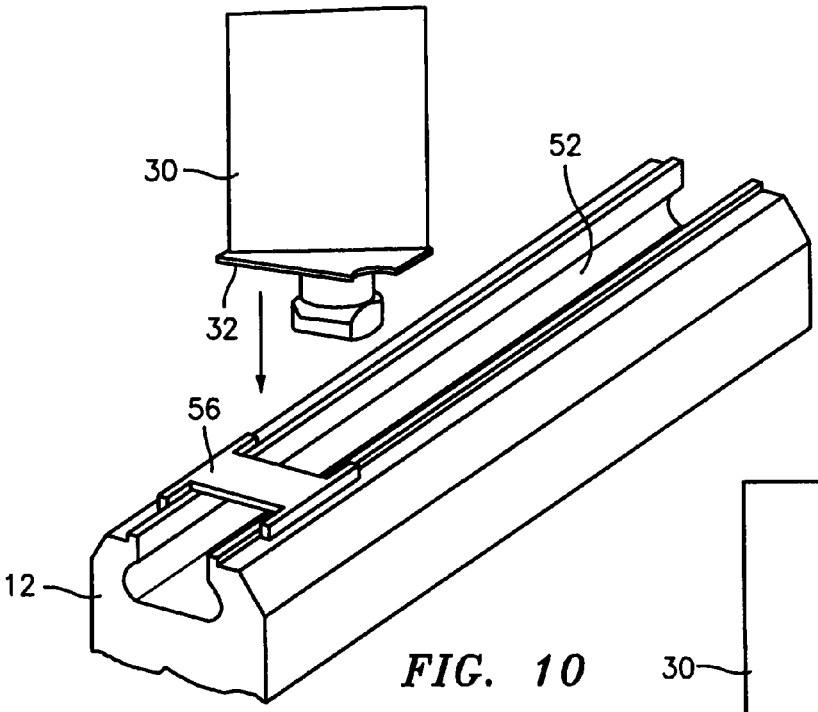
Figure 11:
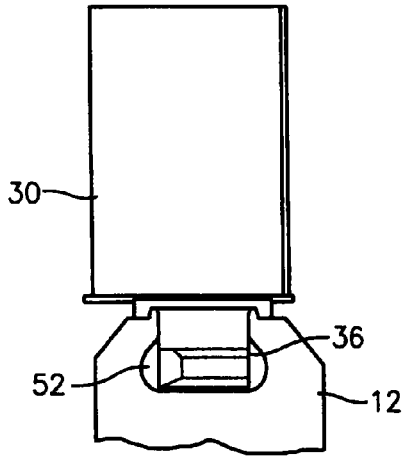
Figure 12:
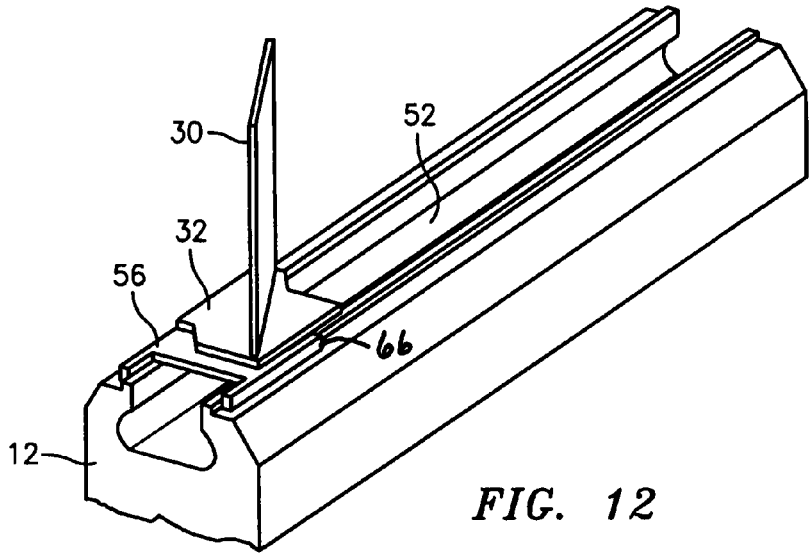

As shown in FIGS. 10 and 11, after the first snap seal 56 has been positioned with respect to the disk 12, a first blade 30 is loaded into the slot 52. The blade 30 is loaded radially into the slot 52 and is then rotated to the position shown in FIG. 7D. Thereafter the blade 30 is slid into position abutting the side edge 66 of the snap seal 56 as shown in FIG. 12. The side edge 66 of the snap seal 56 fits under the platform 32 of the blade 30 so that the platform 32 overlaps a portion of the snap seal 56.

Figure 13:
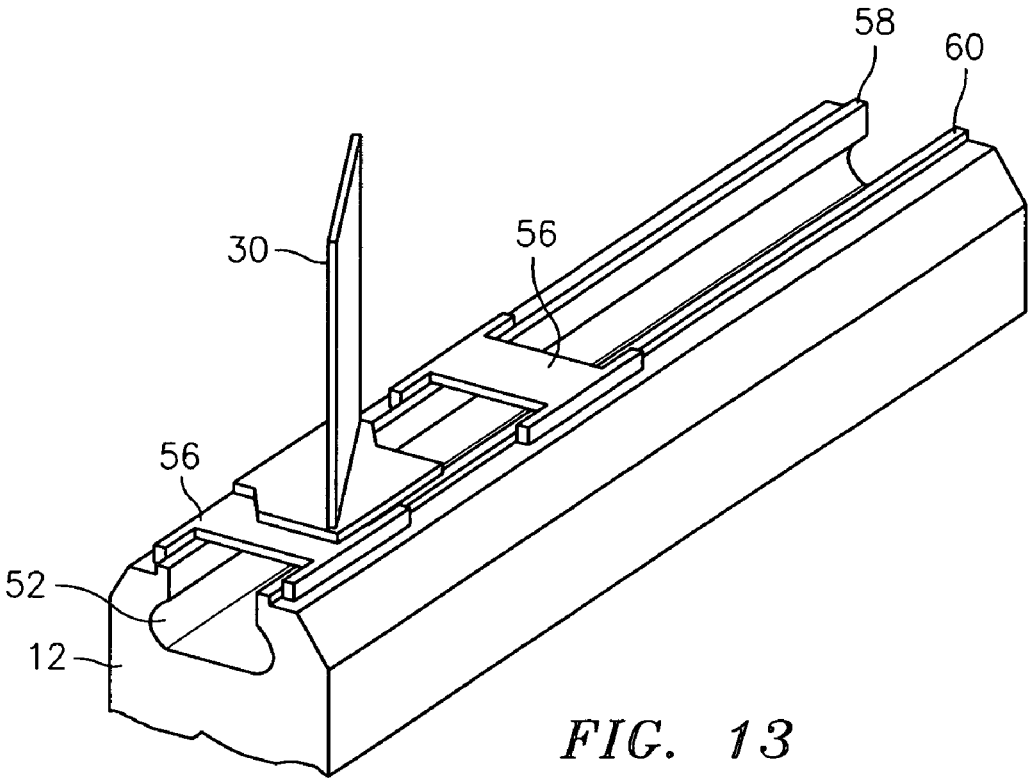
Figure 14:
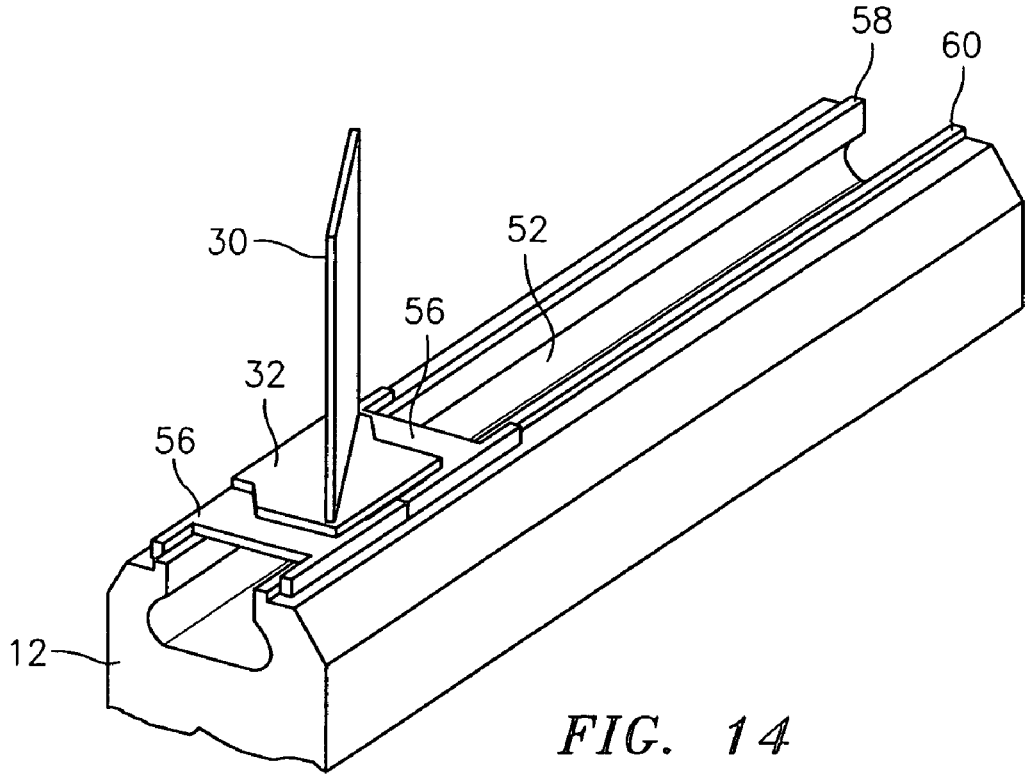
Figure 15:
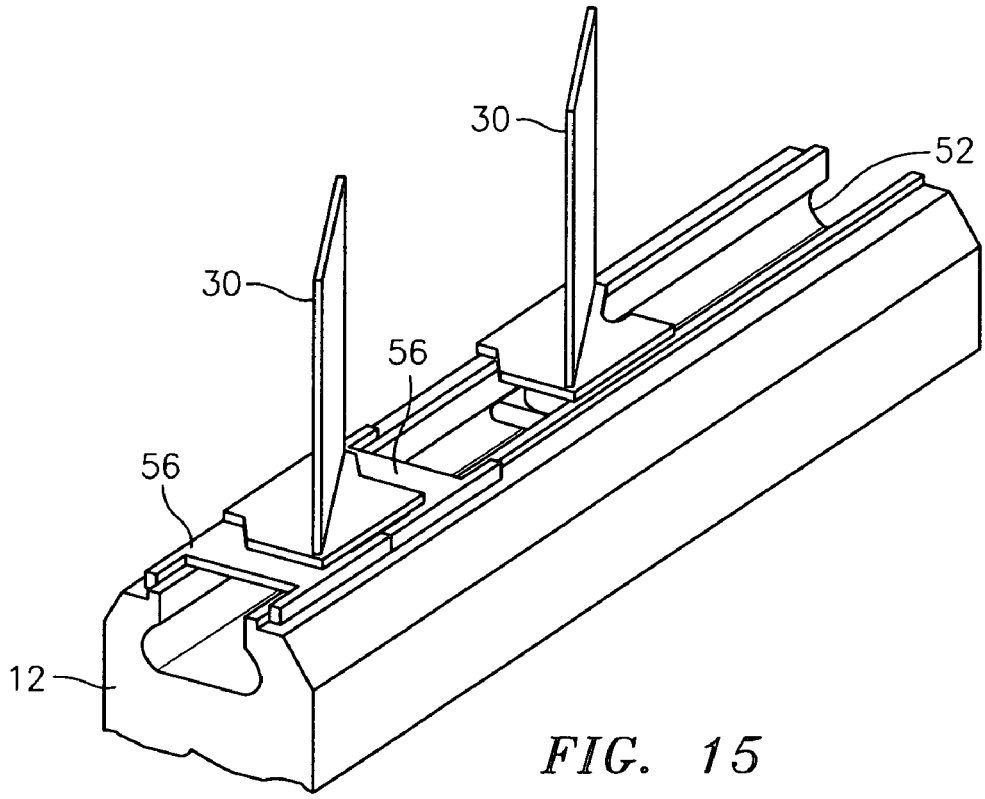
Figure 16:
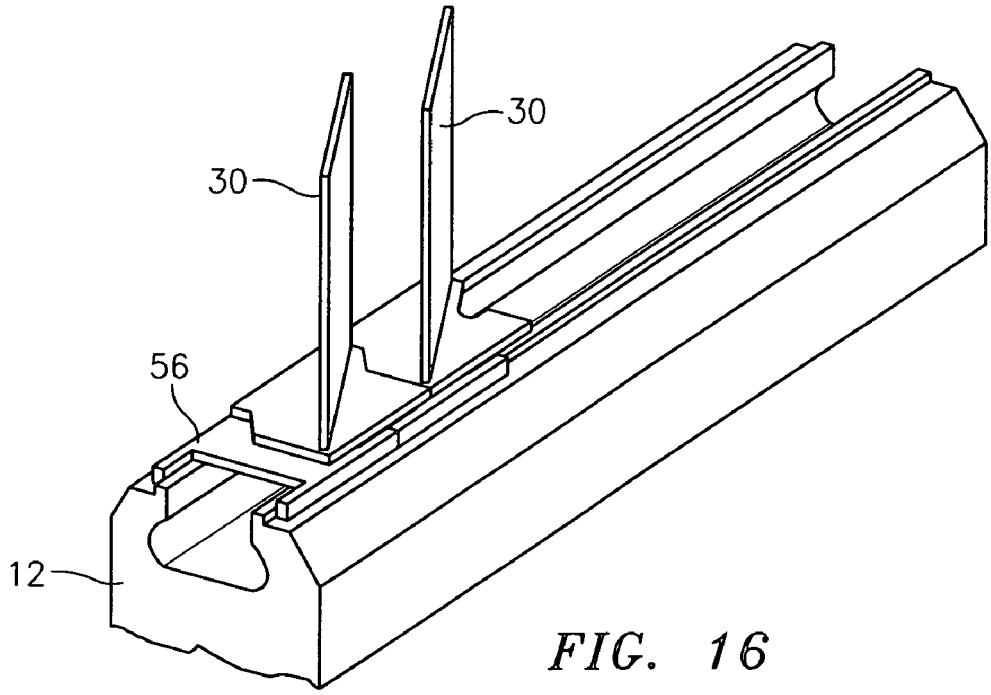
Figure 17:
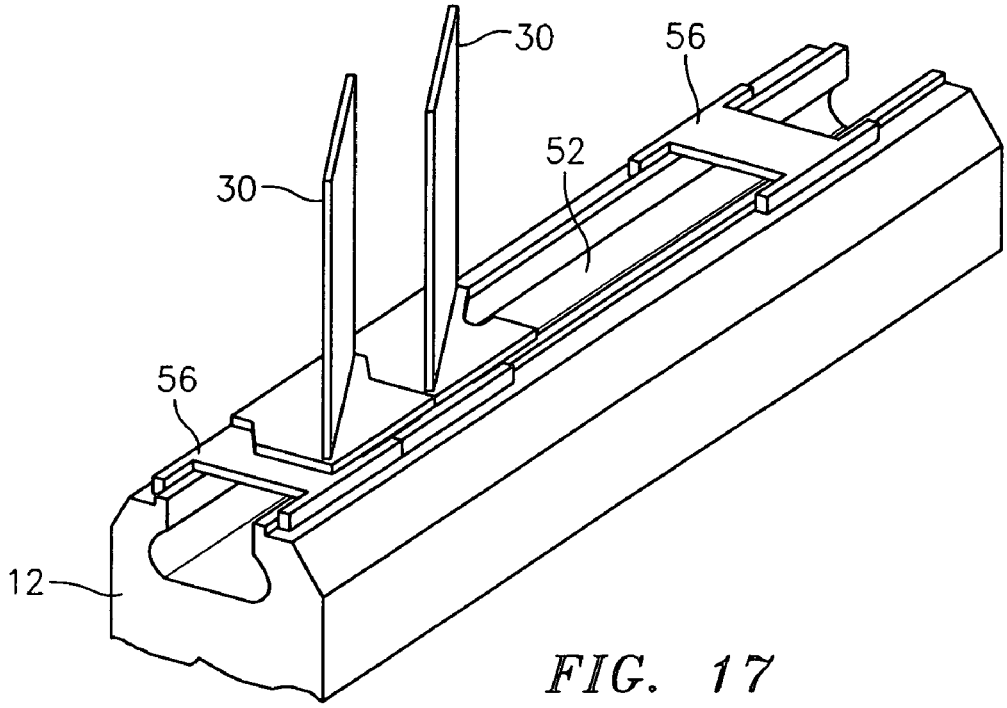
Figure 18:
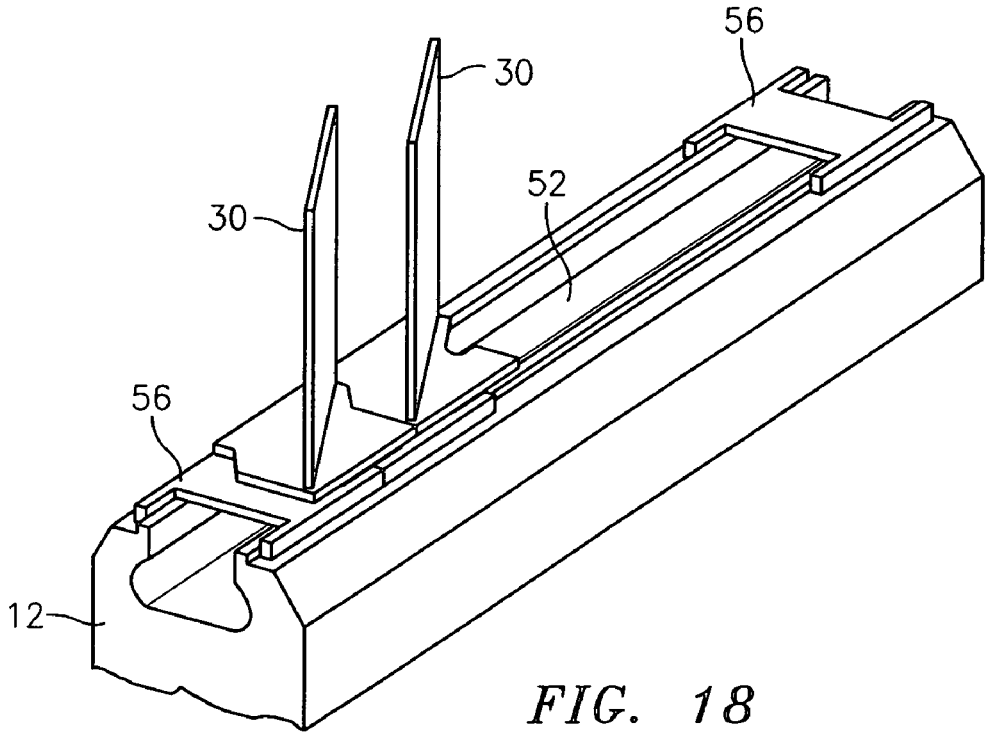
Figure 19:
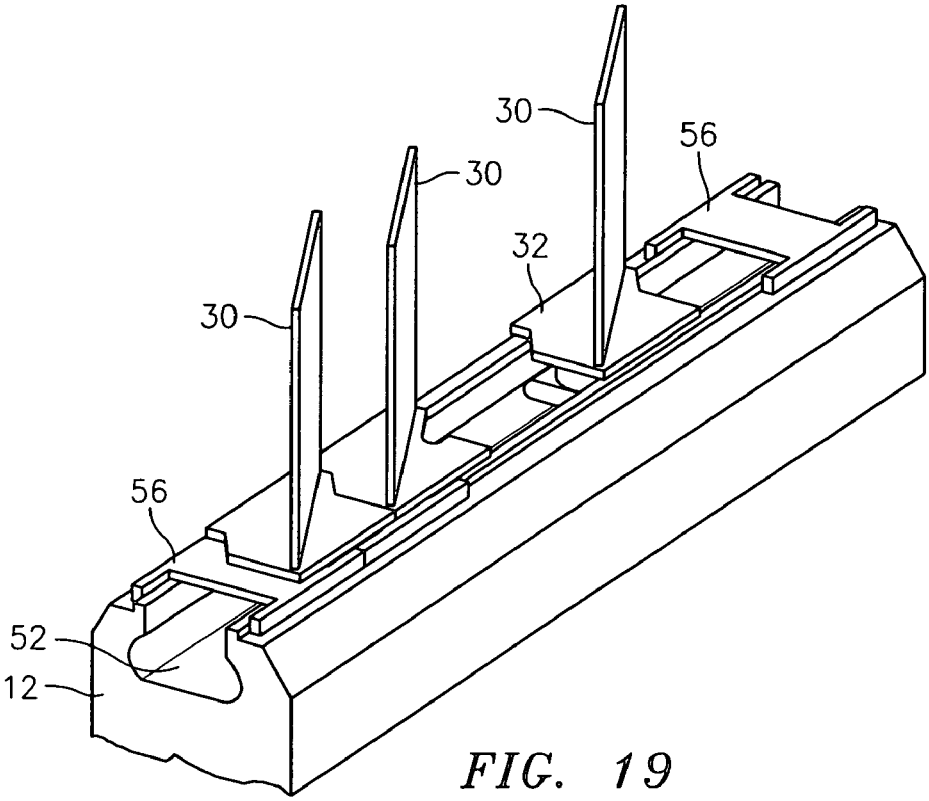
Figure 20:
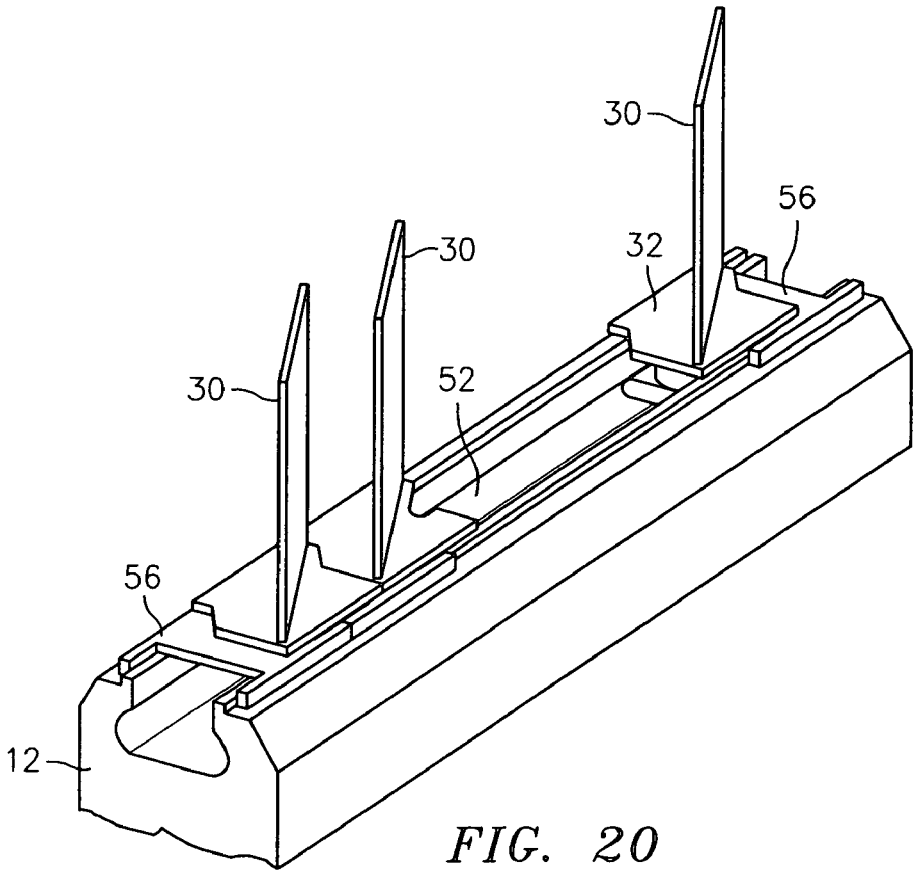
Figure 21:
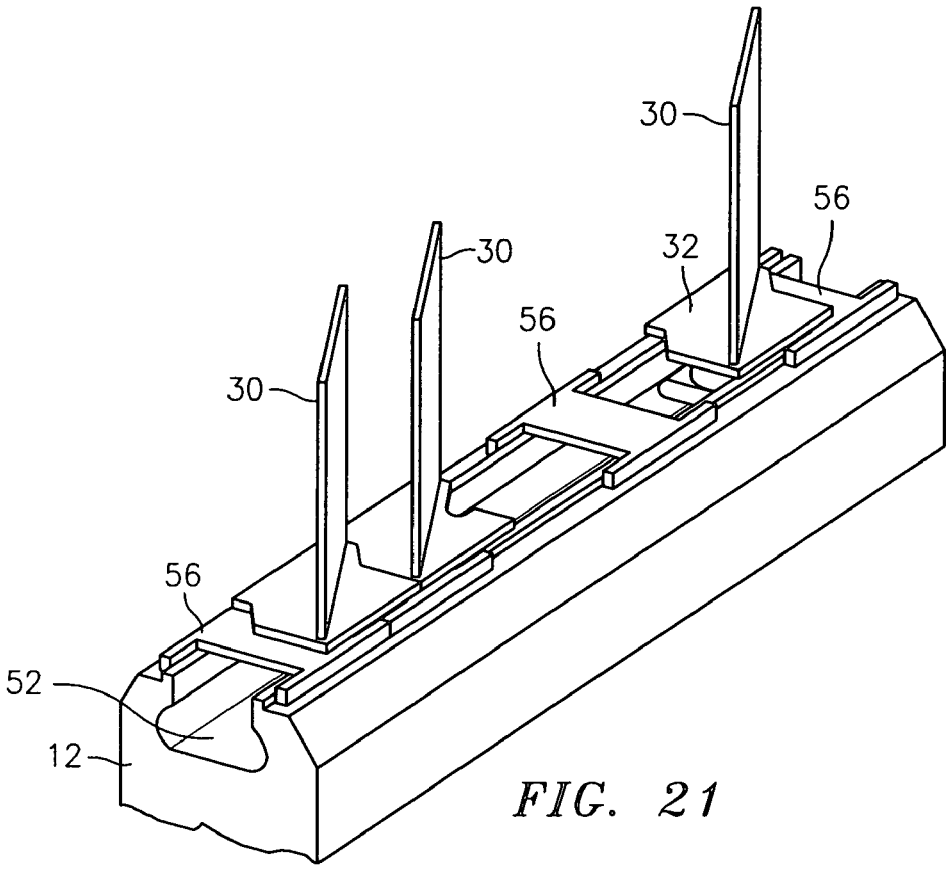
Figure 22:
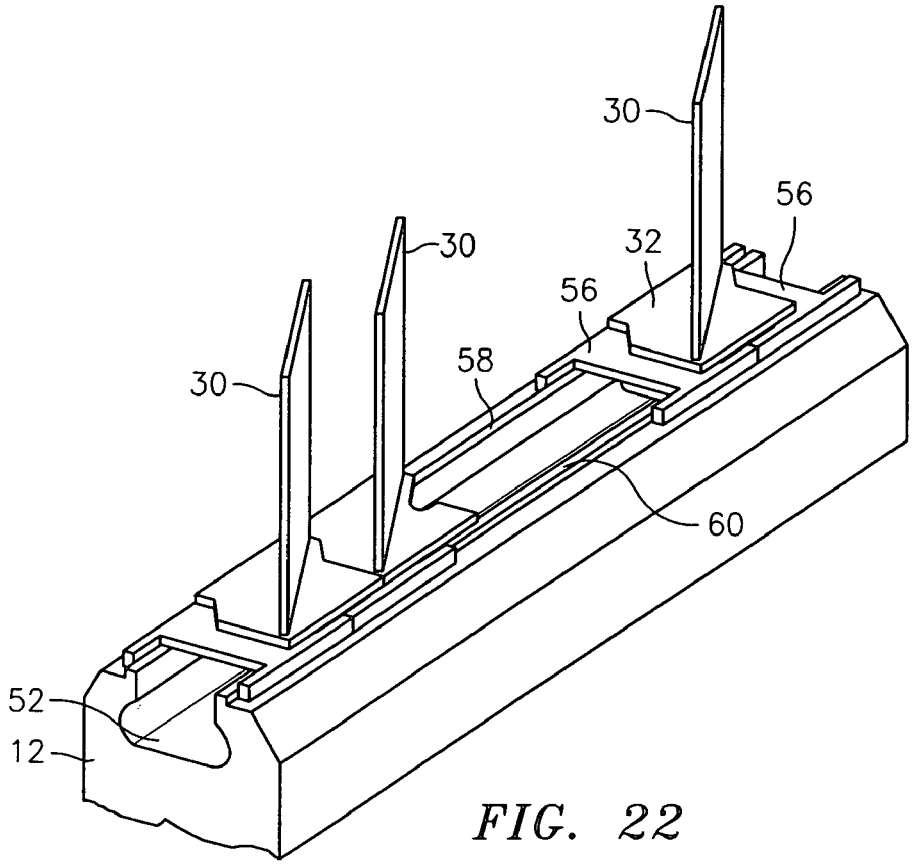
Figure 23:
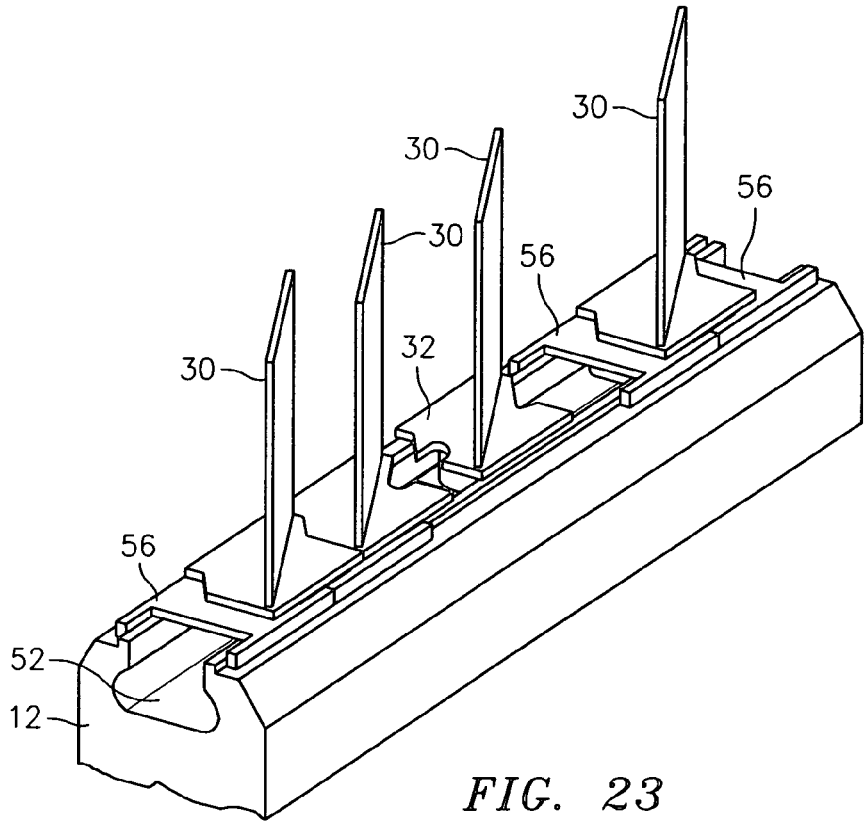
Figure 24:
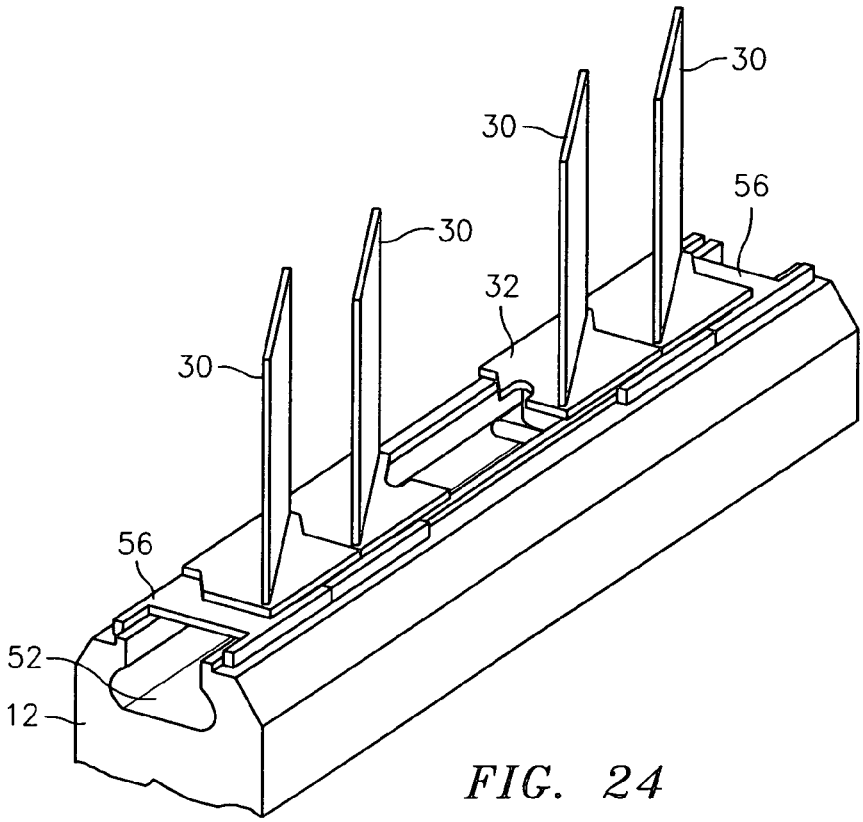
Figure 25:
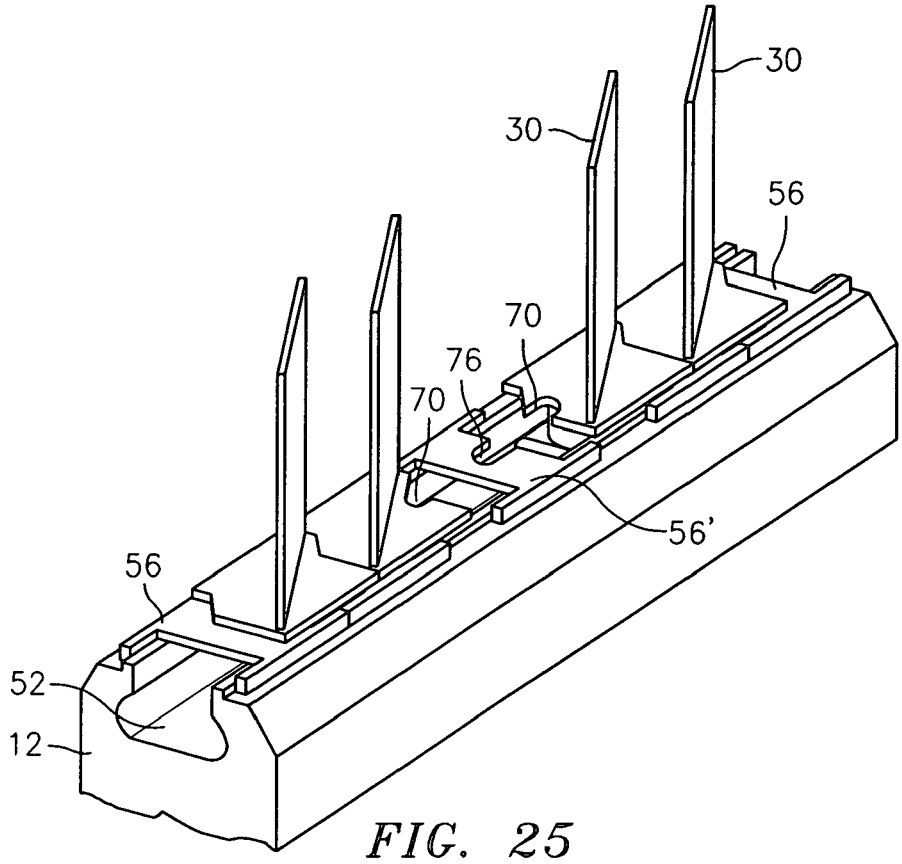
Figure 26:
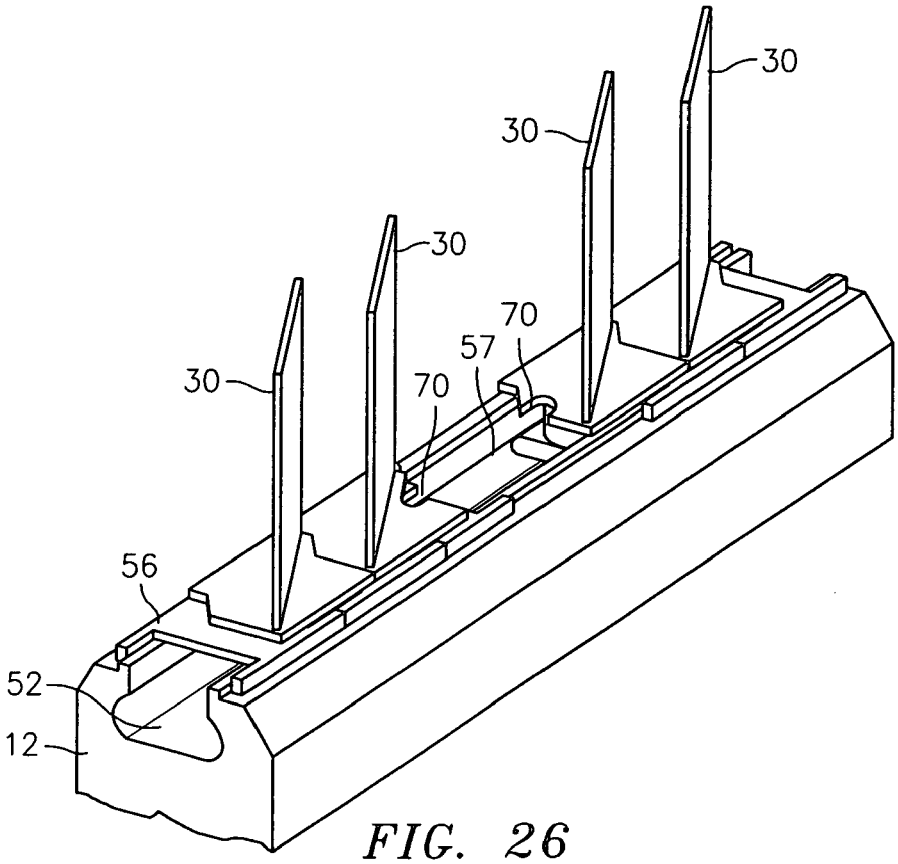
Figure 27:
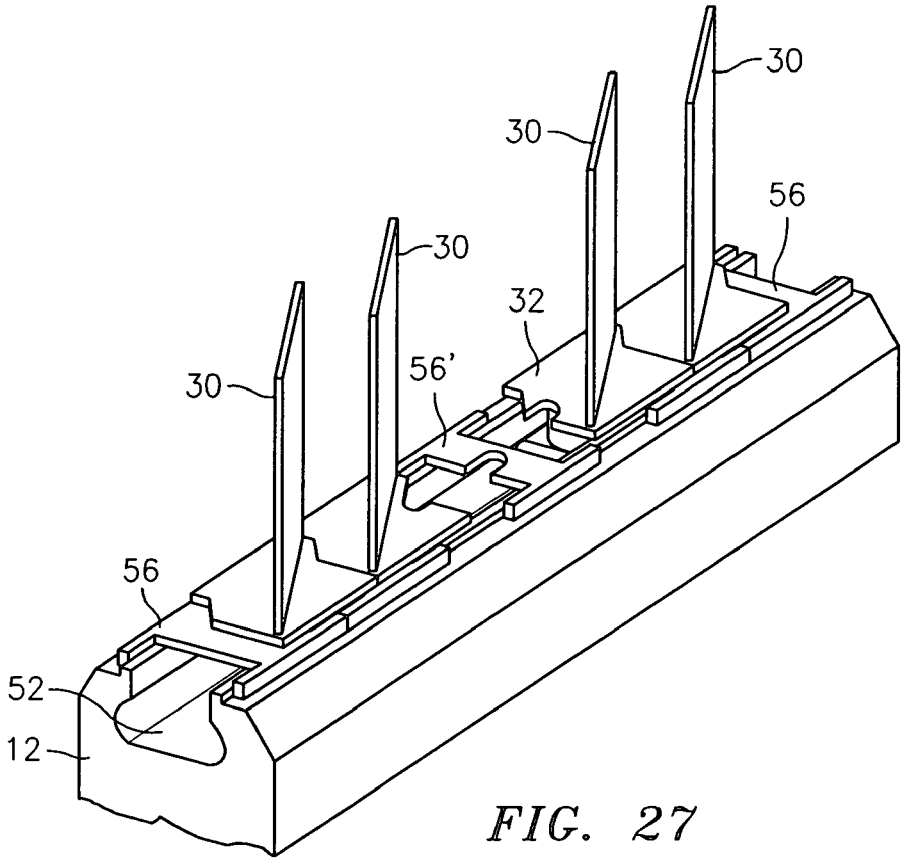
Figure 28:
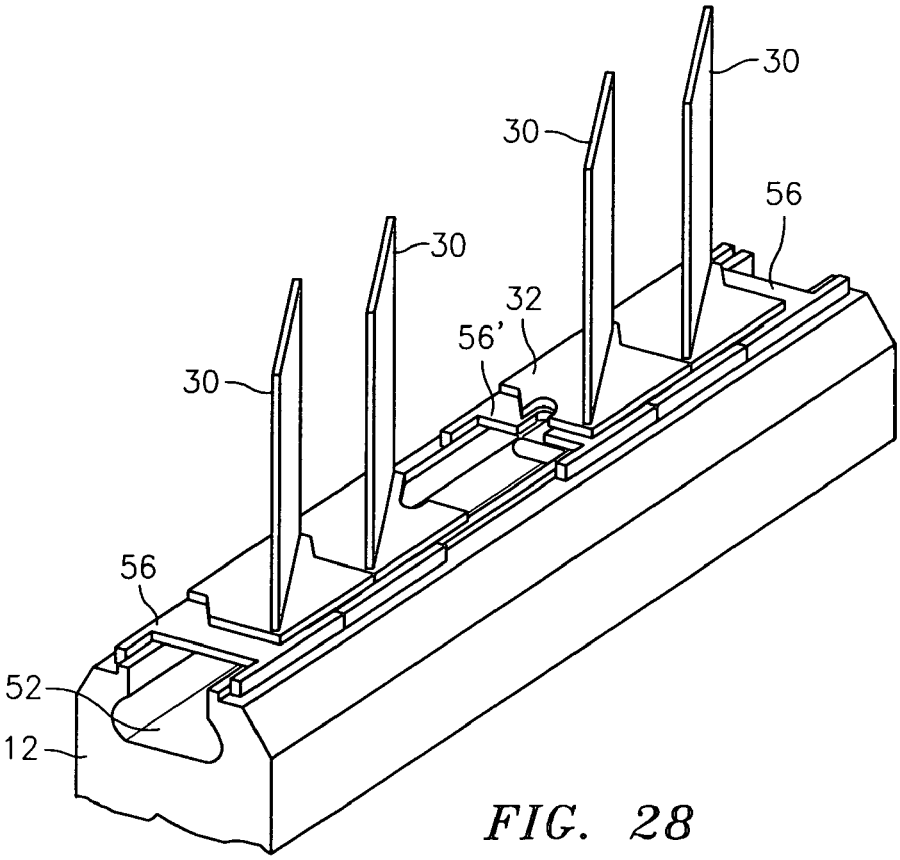

As shown in FIGS. 13 and 14, a second snap seal 56 is then positioned over the rails 58 and 60 and slid into position against the first blade 30, again so that the platform 32 of the first blade 30 overlaps a portion of the second snap seal 56. Thereafter, a second blade 30 is loaded into the slot 52 as shown in FIG. 15 and slid into position against the second snap seal 56 as shown in FIG. 16 with the platform 32 of the second blade 30 overlapping the second snap seal 56 and contacting the platform 32 of the first blade 30. As shown in FIGS. 17 and 18, a third snap seal 56 is loaded and slid into a desired position, preferably spaced from the second blade 30. A third blade 30 is loaded into the slot 52 and positioned against the third snap seal 56 as shown in FIGS. 19 and 20 with the platform 32 of the third blade 30 overlapping a portion of the snap seal 56. As shown in FIGS. 21 and 22, a fourth snap seal 56 is positioned on the rails 58 and 60 and slid into position against the third blade 30 with a portion of the fourth snap seal 56 being overlapped by the platform 32 of the third blade 30. Referring now to FIGS. 23 and 24, a fourth blade 30 is inserted into the slot 52 and slid into position against the third blade 30 and with the platform 32 of the fourth blade 30 overlapping the fourth snap seal 56.

Figure 37:
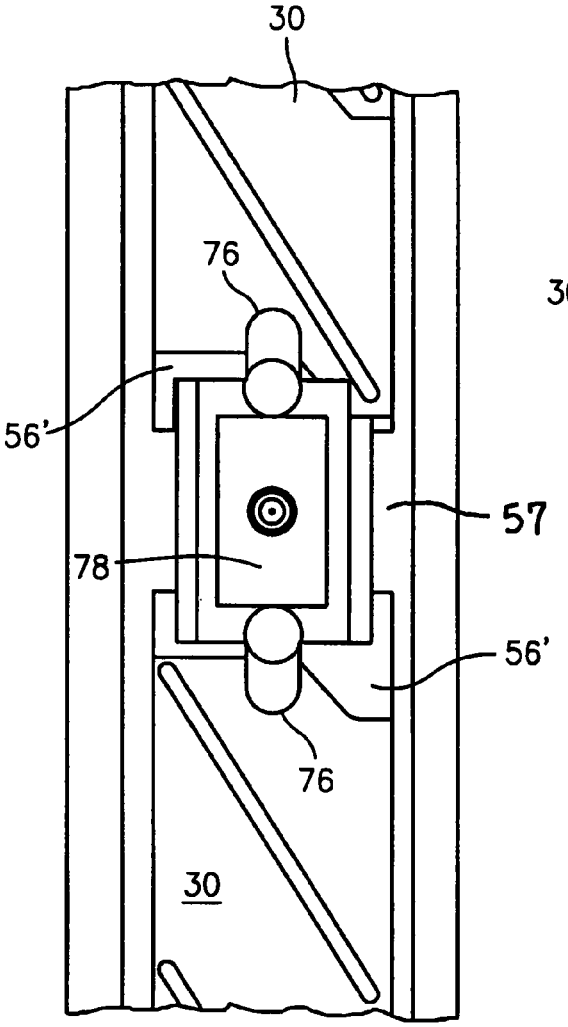
FIG. 37 is a top view of the blades and snaps seals used as part of the assembly procedure for the last blade.

The method of loading snap seals and blades as described above is repeated until there is a space 57 for one last blade known as the load locking blade 30'. The load locking blade 30' is the centermost one of the blades in the blade array 72 thus formed. As can be seen in FIG. 37, each of the two blades 30 and snap seals 56' bordering the space 57 preferably has a notch or slot 76 for receiving a locking pin 74.

Referring now to FIGS. 25-28 and 37, a pair of snap seals 56' is loaded into the slot 52 and slid into position against one of the two blades 30 bordering the space 57. Again the platform 32 of each of these two blades overlaps a portion of a respective snap seal 56'. Each of the snap seals 56' has a notch or slot 76 which aligns with the blade notches or slots 70.

Figure 29:
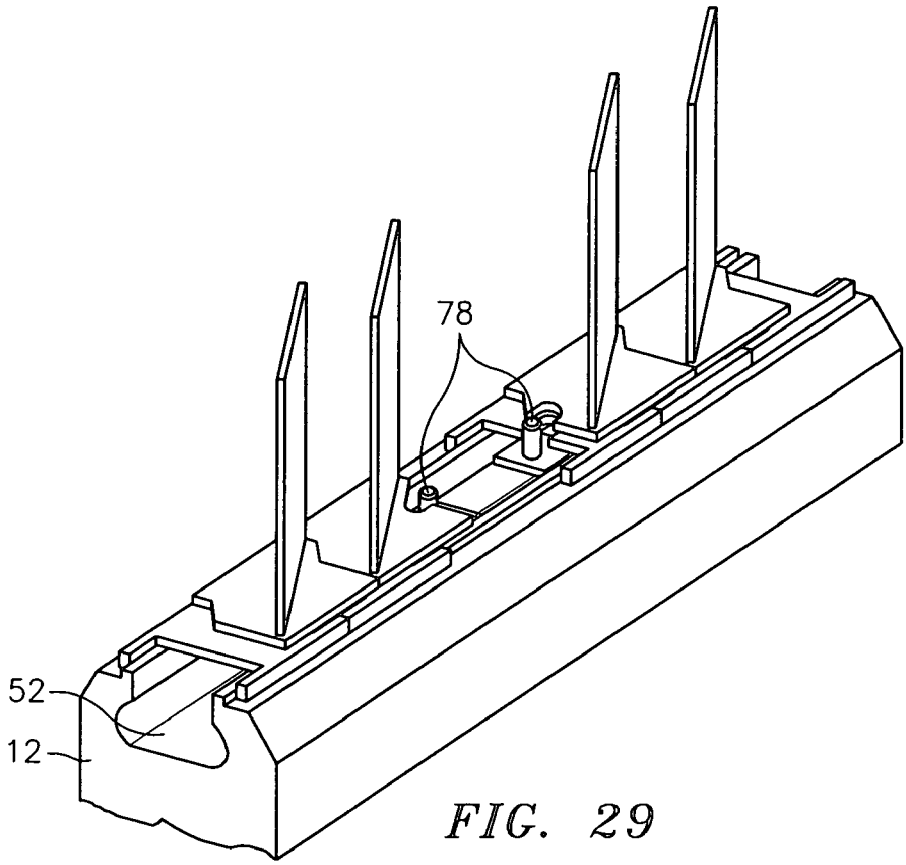
Figure 30:
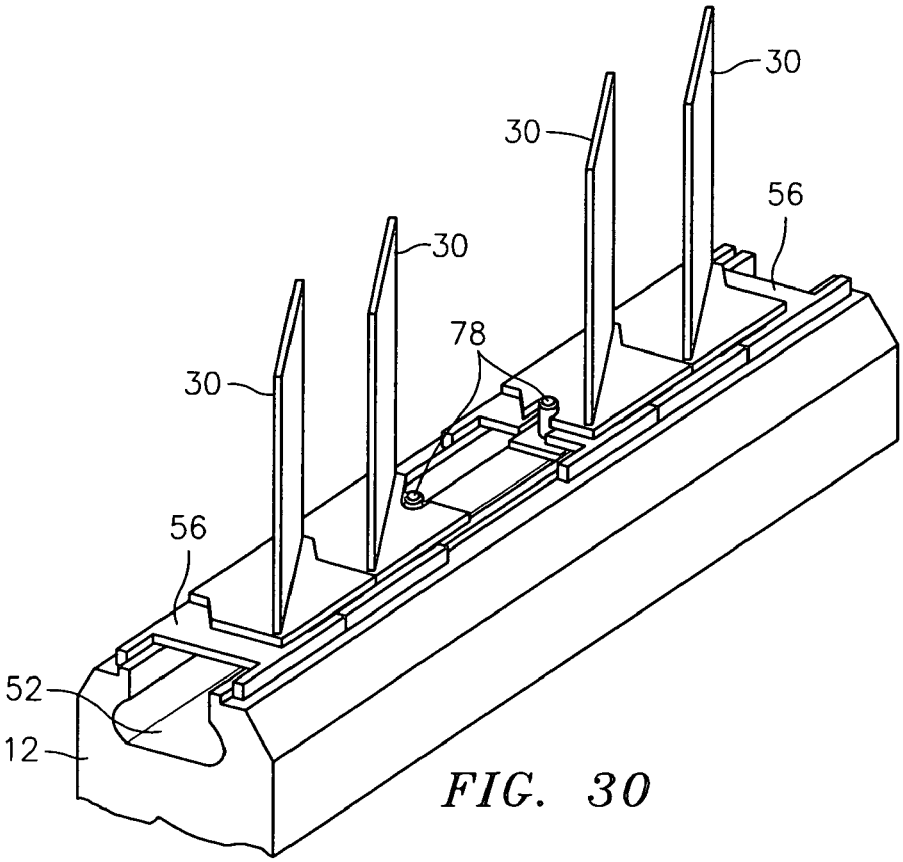
Figure 36:
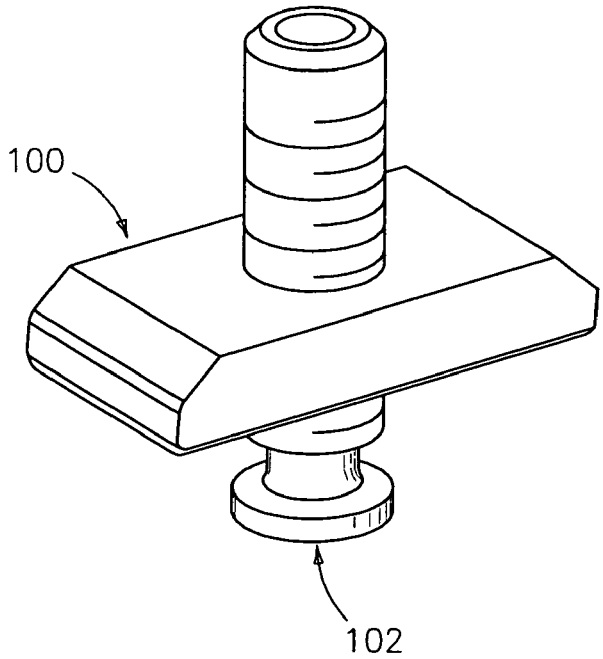
FIG. 36 is a perspective view of a load lock assembly.
Figure 38:
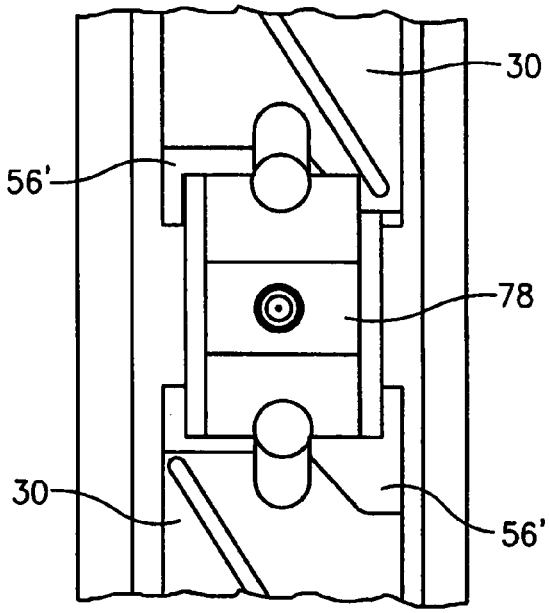
FIGS. 38-40 illustrate the procedure for positioning the load lock assembly.
Figure 39:
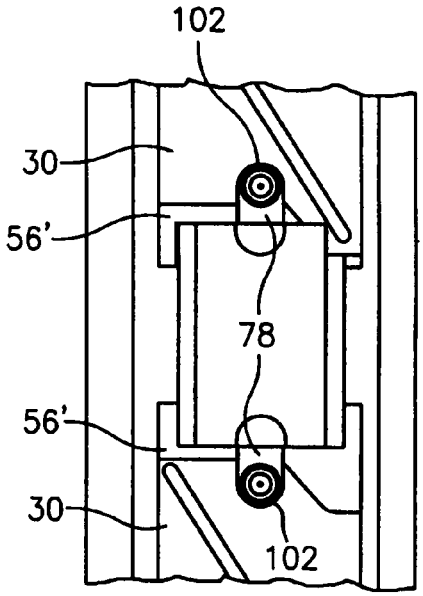
Figure 40:
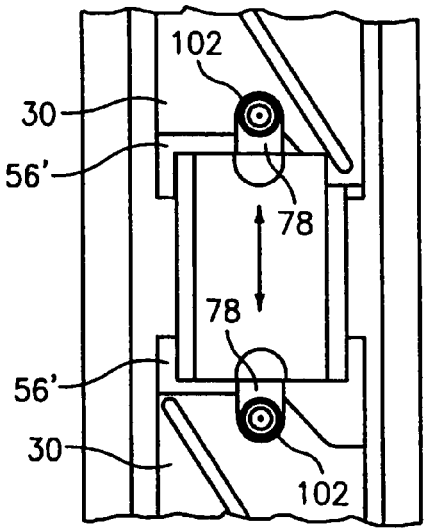

Thereafter, as shown in FIGS. 29 and 30, a pair of load locks 78 are loaded into the slot 52 and slid into slots of the blade platform. The load locks 78, as can be seen from FIG. 36, each include a threaded spacer 100 and a set screw 102 which serves as the locking pins 74. As can be seen from FIGS. 38-40, each of the load locks is initially positioned between the disk rails 58 and 60 so that its longitudinal axis is parallel to the disk rails 58 and 60. Thereafter, each load lock is rotated 90 degrees so that its longitudinal axis is perpendicular to the disk rails 58 and 60. Each load lock is then slid against one of the two blades 30 defining the space 57 so that the set screw fits into the notches or slots 70 and 76.

Figure 31:
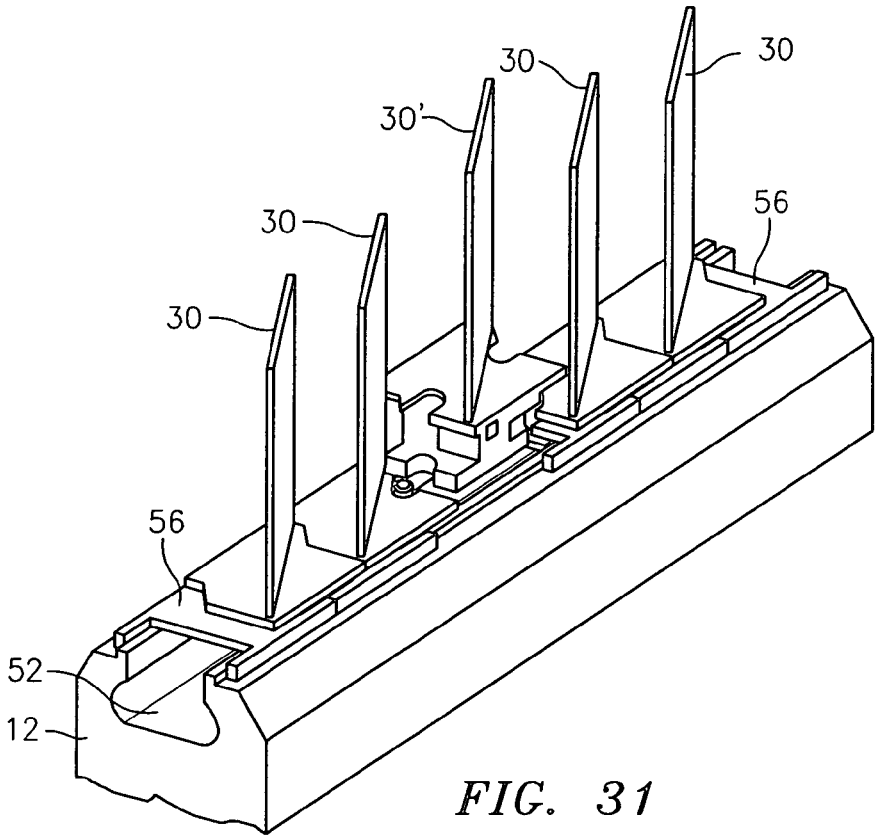
Figure 32:
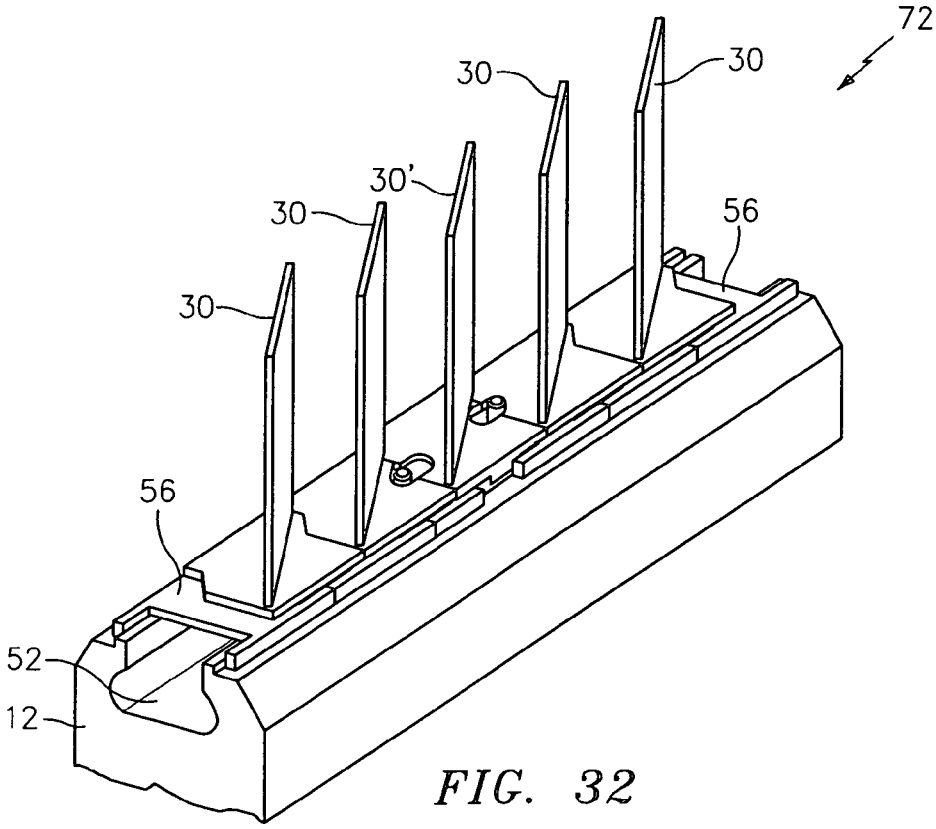
Figure 33:
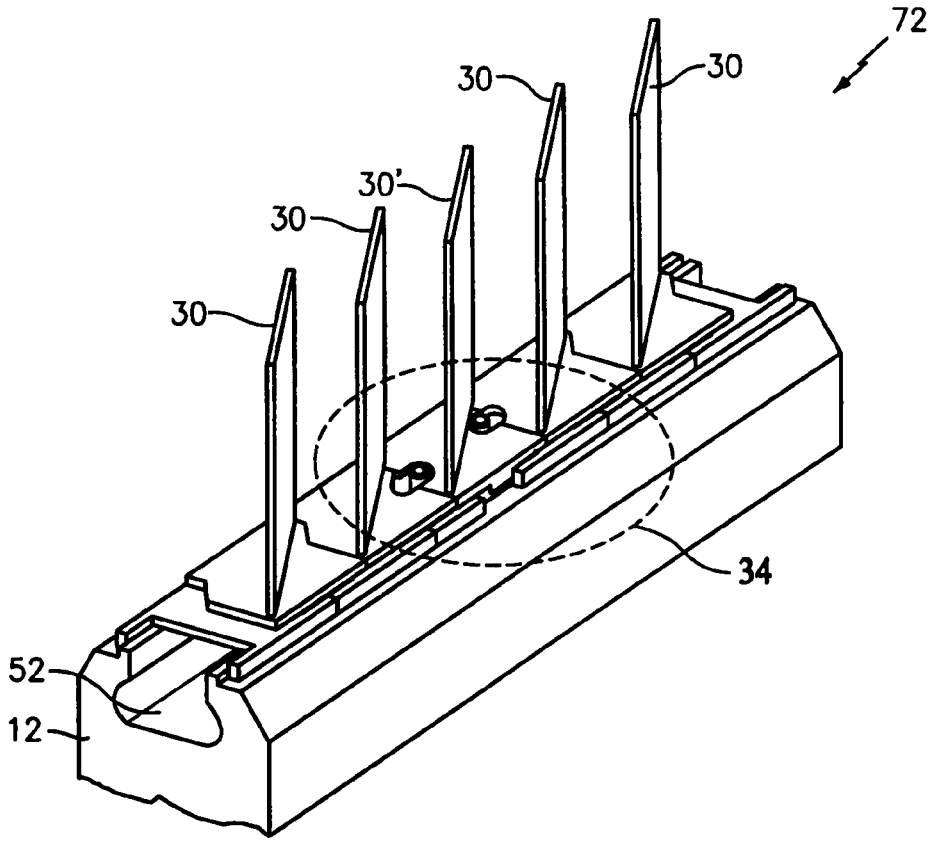

As shown in FIGS. 31 and 32, the load locking blade 30' is loaded radially into the slot 52. The load locking blade 30' as shown in FIGS. 33 and 34 has a pair of slots 80, one on each side, for receiving a portion of the set screws 102 of the load lock assemblies 78. The load locking blade 30' also has a pair of notches 82 in the platform 84 for receiving the locking pins 74, which are the set screws 102.

Figure 41:
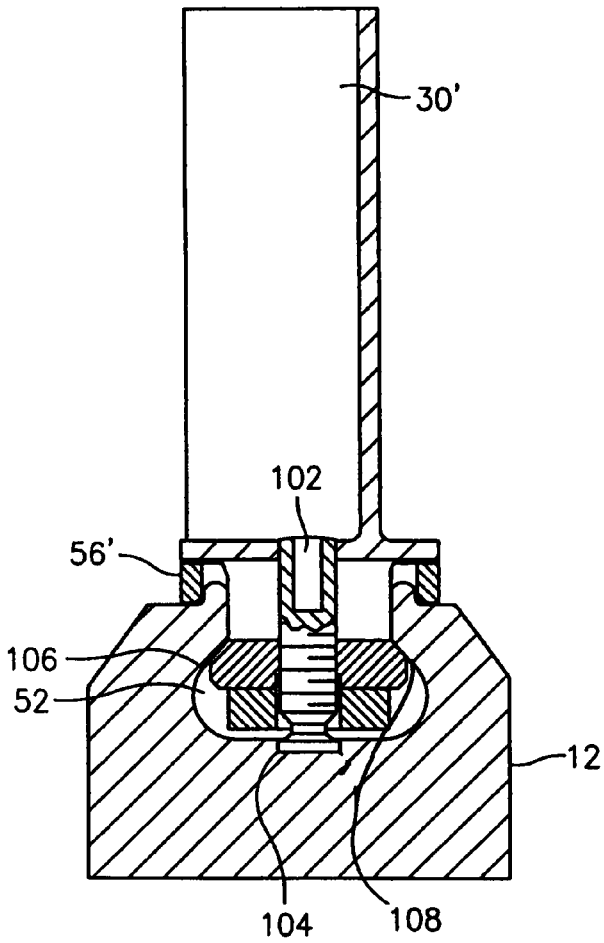
FIG. 41 is a sectional view of the disk showing the locking blade positioned within the slot in the disk.
Figure 43:
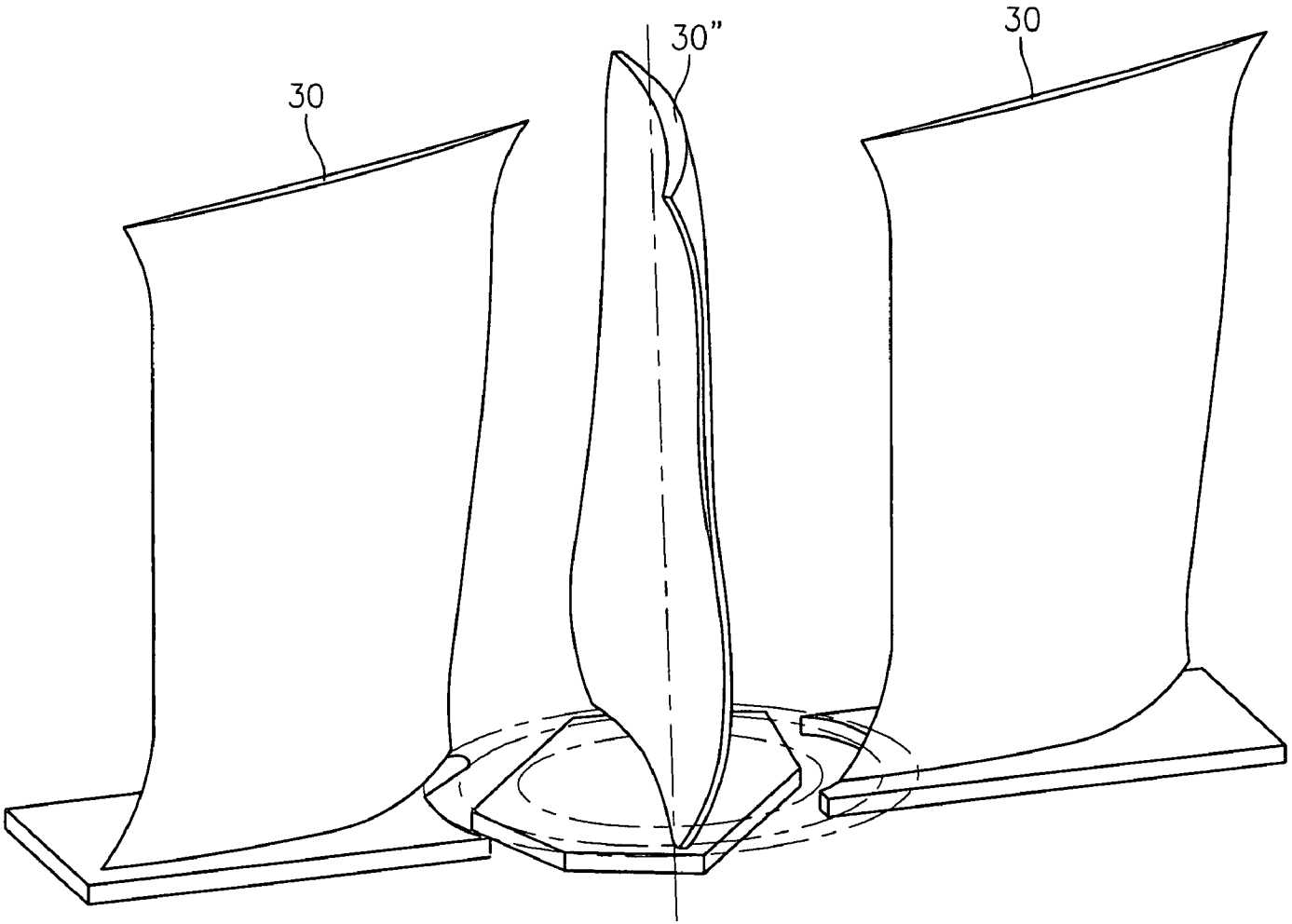
FIGS. 43-47 illustrate an alternative embodiment of a lock blade.
Figure 44:
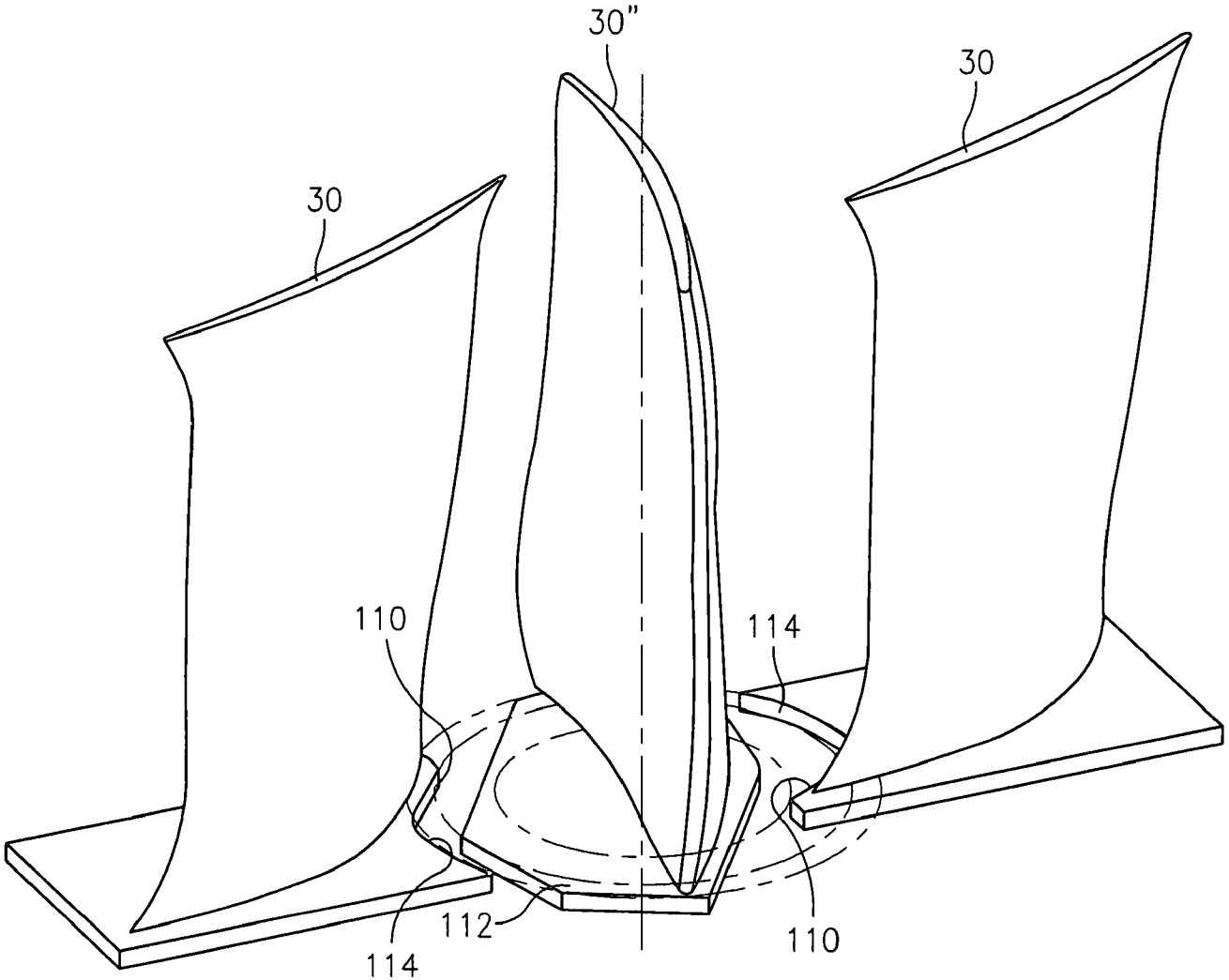
Figure 45:
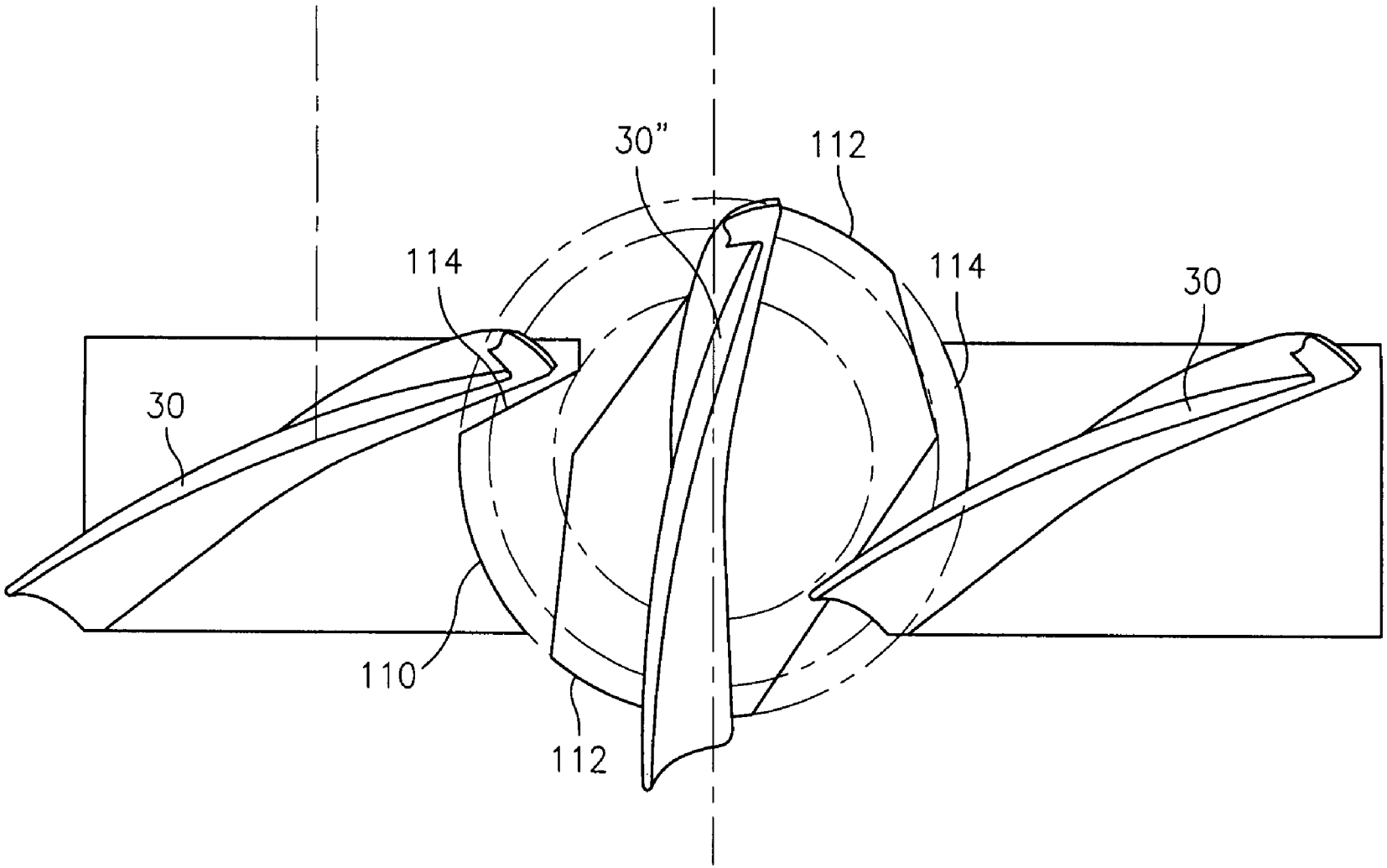
Figure 46:
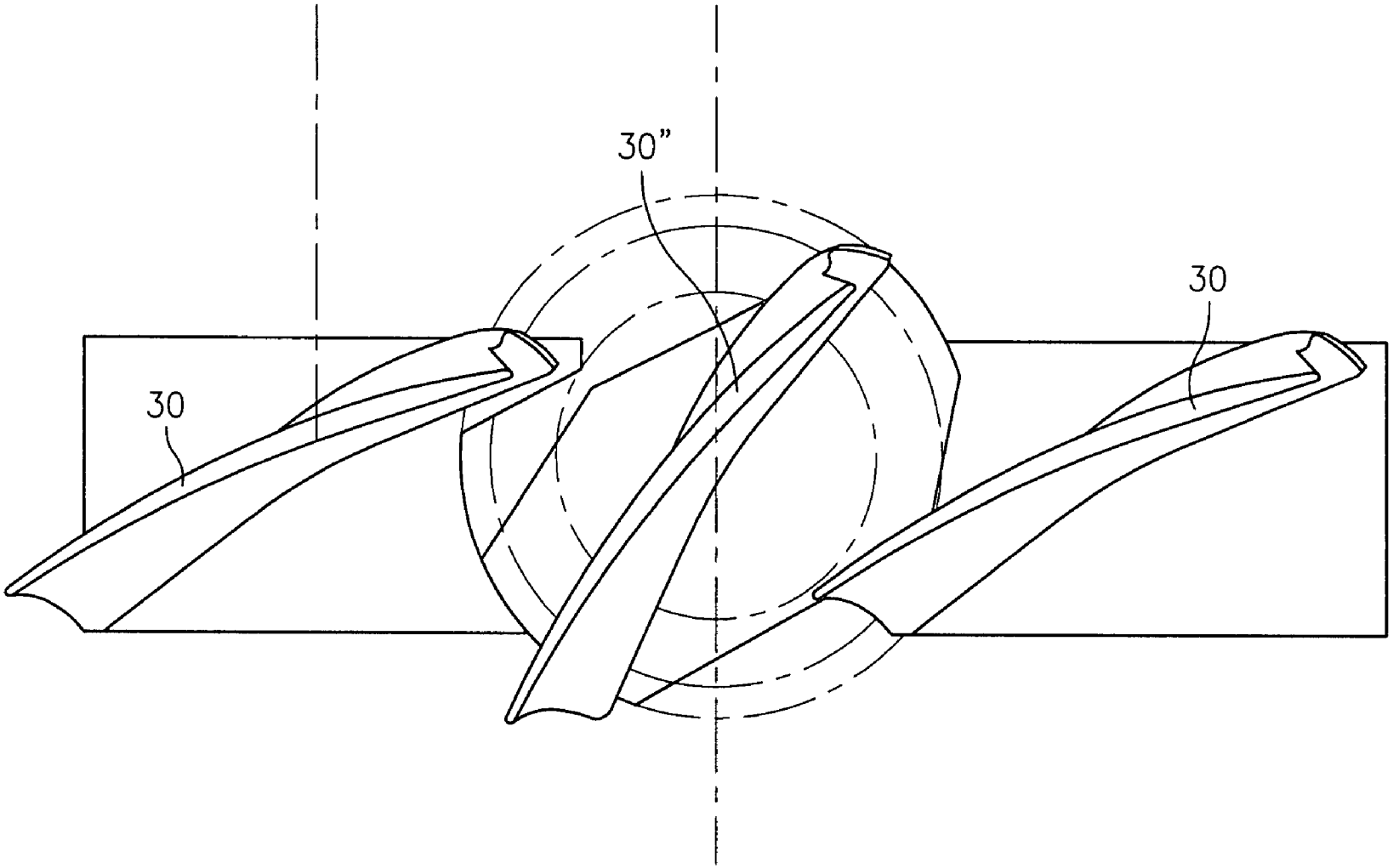
Figure 47:
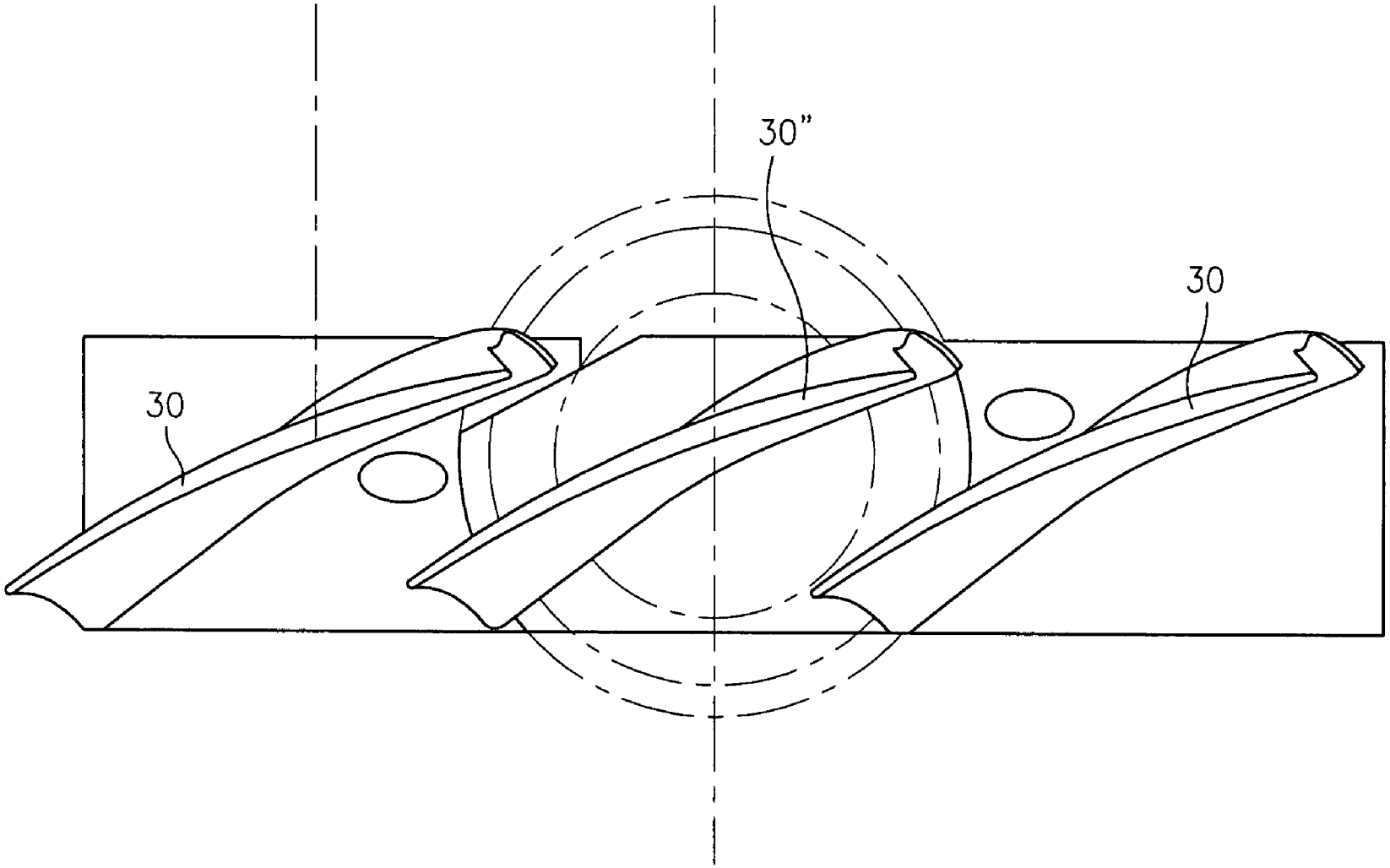

Referring now to FIG. 41, there is shown the load locking blade 30' secured in position in the slot 52 in the disk 12. The disk 12 has a pair of features 104 machined in it for receiving each of the set screws 102. Each feature 104 may be a counter bored hole. Other machined features could also be used. After the blade 30' has been positioned, each set screw 102 is threaded until it bottoms out on the disk 12 and the spacer 100 loads up against the bearing faces 106 and 108.

The attachment part of the blades of the present invention provides a number of benefits. For example, it allows the tangential rotor disk to be manufactured without loading and locking slots. It also allows the blades to be loaded radially and rotated into position without having to be slid circumferentially, which reduces assembly time and improves ergonomics. Still further, it has a negligible impact on weight.

The tangential rotor disk without loading and locking slots removes stress concentrations due to loading and locking slots and significantly improves TMF life on rear disk stages. Still further, it reduces manufacturing costs and has a negligible impact on weight.

The snap seals of the present invention minimize radial float of the blades once rotated into position. They also help to prevent shingling, which occurs when adjacent platforms lay on top of each other, and decrease aerodynamic leakage.

Figure 42:
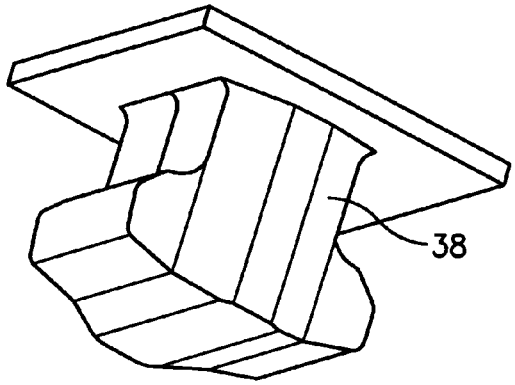
FIG. 42 illustrates a modified shape for the neck portion of the blades used in the system of the present invention.

While the blade 30 has been described as having a circular neck portion 38, the neck portion can have other non-rectangular shapes besides circular. For example, the neck portion 38 could have the shape shown in FIG. 42. This shape is advantageous because it provides an improved stress field at the neck to dovetail transition. The neck portion 38 can have any cross sectional appearance, given it fits within a diameter less than or equal to the throat portion of the disk slot 52. This is necessary to allow the blade to be radially rotated into position. Depending on size, the clearance chamfers may not be needed for blades having this neck configuration.

FIGS. 43-47 illustrate an alternative embodiment of a lock blade 30". The benefit of this alternative lock blade embodiment is that allows the attachment point of each blade, which consists of the neck and dovetail portion, to be the same for all blades. As can be seen from these Figures, the blades 30 each have a cut-out portion 110. The lock blade 30" has portions 112, which are shaped to mate with the cut-out portion 110 in each blade 30 so that the lock blade 30" can be loaded radially and rotated into place. To allow this, each cut-out portion has an arcuate section 114 which allows the blade 30" to be rotated into place. As before, snap seals 56' are provided. Each snap seal 56' and each platform in each blade 30 is provided with a mating slot which allows the load lock assemblies to be used to secure the lock blade 30" in place.

It is apparent that there has been provided a method for loading and locking tangential rotor blades and a blade design which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. An array of blades for use in an engine comprising:

a disk having a slot, a pair of rails adjacent the slot and extending above an upper surface of said slot, and a pair of shoulders located outside said rails;

a plurality of radially loaded blades inserted into said slot;

a plurality of snap seals which overhang said rails and rest on said shoulders; and each of said blades being positioned between a pair of snap seals and overlapping a side edge of each one of said pair of snap seals.

2. The array of claim 1, wherein:

said slot is a tangential slot;

each of said rails has an inner surface adjacent said tangential slot and an outer surface opposed to said inner surface, and each said shoulder portion abuts said outer surface of one of said rails, and said rails extend above said shoulder portions.

3. The array according to claim 2, wherein said tangential slot has a continuous sectional profile.

4. The array of claim 1, wherein said slot has a continuous sectional profile.

5. The array of claim 1, wherein each said blade has a platform, an airfoil portion extending radially above said platform, and an attachment part beneath said platform.

6. The array of claim 5, wherein said attachment part comprises a non-rectangular neck portion and a dovetail portion.

7. The array of claim 6, wherein said neck portion is circular.

8. The array of claim 6, wherein said neck portion is multi-sided.

9. The array of claim 6, wherein said dovetail portion has two opposed end faces and wherein each of said end faces has upper and lower chamfered edges.

10. The array of claim 6, wherein each said dovetail portion has two flat sides and each said side is perpendicular to a longitudinal axis of said slot when said blade is positioned within said slot.

11. The array of claim 5, further comprising a pair of load locks and each of said load locks being positioned so as to mate with a notch in a platform of one of said blades.

12. The array of claim 11, further comprising a load locking blade and said load locking blade being held in place by said load locks.

13. The array of claim 12, wherein each of said load locks includes a set screw and said load locking blade has a plurality of notches for receiving a plurality of said set screws.

14. The array of claim 1, wherein said plurality of blades includes a first blade and a second blade which define a space for a load locking blade, each of said first blade and said second blade having a cut-out portion, and said load locking blade having a platform with mating portions for fitting into said and mating with said cut-out portions in said first and second blades.

15. A method of loading and locking a plurality of tangential rotor blades comprising the steps of:

providing a disk having a tangential slot, a pair of rails adjacent said slot and extending above an upper boundary of said slot, a first shoulder positioned outwardly of and adjacent to a first one of said rails and a second shoulder positioned outwardly of and adjacent to a second one of said rails, and said rails extending above said shoulders;

positioning a first snap seal in a desired location so that said snap seal extends over said slot and said rails and rests on said shoulders;

radially loading a first blade having a platform into said slot and rotating said blade after said blade has been loaded into said slot; and positioning said first blade adjacent said snap seal so that a portion of said snap seal slides under said platform.

16. The method of claim 15, further comprising:

loading a second snap seal onto said rails; and moving said second snap seal into position adjacent said first blade so that said second snap seal slides under said platform of said first blade.

17. The method of claim 16, further comprising:

radially loading a second blade having a second platform into said slot and rotating said second blade; and sliding said second blade into a position adjacent said second snap seal so that a portion of said second snap seal slides under said platform of said second blade.

18. The method of claim 17, further comprising:

loading additional snap seals and blades until there is a space for only one more blade.

19. The method of claim 18, further comprising:

loading a pair of locks into said slot and sliding each of said locks into a slot in a blade platform of a blade adjacent to said space.

20. The method of claim 19, further comprising:

radially loading a load locking blade into said space; and positioning said locks to secure said load locking blade into place.

* * * * *